US008674045B2

(12) United States Patent
Tanaka et al.

(10) Patent No.: US 8,674,045 B2
(45) **Date of Patent: *Mar. 18, 2014**

(54) CARBON-FIBER PRECURSOR FIBER, CARBON FIBER, AND PROCESSES FOR PRODUCING THESE

(75) Inventors: Fumihiko Tanaka, Ehime (JP); Makoto Endo, Ehime (JP)

(73) Assignee: Toray Industries, Inc. (JP)

( * ) Notice: Subject to any disclaimer, the term of this patent is extended or adjusted under 35 U.S.C. 154(b) by 267 days.

This patent is subject to a terminal disclaimer.

(21) Appl. No.: 12/936,406

(22) PCT Filed: Apr. 10, 2009

(86) PCT No.: PCT/JP2009/057332

§ 371 (c)(1), (2), (4) Date: Oct. 5, 2010

(87) PCT Pub. No.: WO2009/125832

PCT Pub. Date: Oct. 15, 2009

(65) Prior Publication Data

US 2011/0038788 A1 Feb. 17, 2011

(30) Foreign Application Priority Data

Apr. 11, 2008 (JP) ..... 2008-103207

(51) Int. Cl.

| | |
|---|---|
| ***C08F 20/44*** | (2006.01) |
| ***D02G 3/00*** | (2006.01) |
| ***B32B 9/00*** | (2006.01) |
| ***B32B 27/00*** | (2006.01) |

(52) U.S. Cl.

USPC ..... 526/341; 428/364; 428/367; 428/392; 428/394; 428/397; 428/399; 428/400; 428/401

(58) Field of Classification Search

USPC ..... 264/29.2, 204, 205, 206; 423/447.1, 423/447.2; 428/364, 367, 392, 394, 397, 428/399, 400, 401, 902, 903; 526/341

See application file for complete search history.

(56) References Cited

U.S. PATENT DOCUMENTS

| | | | |
|---|---|---|---|
| 4,658,004 | A | 4/1987 | Kobashi et al. |
| 5,269,984 | A | 12/1993 | Ono et al. |
| 5,348,802 | A | 9/1994 | Matsuhisa et al. |
| 2004/0127647 | A1 | 7/2004 | Ong et al. |
| 2007/0142564 | A1 | 6/2007 | Reif et al. |
| 2010/0003515 | A1 | 1/2010 | Tanaka et al. |

FOREIGN PATENT DOCUMENTS

| | | | |
|---|---|---|---|
| CN | 1417393 | A | 5/2003 |
| CN | 1598090 | A | 3/2005 |
| CN | 1705710 | A | 12/2005 |
| EP | 1 801 126 | A2 | 12/2006 |
| EP | 1 921 183 | A1 | 5/2008 |
| EP | 1 961 847 | A1 | 8/2008 |
| JP | 58-186614 | | 10/1983 |
| JP | 59-021709 | | 2/1984 |
| JP | 61-014206 | | 1/1986 |
| JP | 61-097415 | | 5/1986 |
| JP | 62-257422 | | 11/1987 |
| JP | 63-123403 | | 5/1988 |
| JP | 63-182317 | | 7/1988 |
| JP | 63-275717 | | 11/1988 |
| JP | 64-077618 | | 3/1989 |
| JP | 3-180514 | | 8/1991 |
| JP | 3-185121 | | 8/1991 |
| JP | 3-210309 | | 9/1991 |
| JP | 4-222229 | | 8/1992 |
| JP | 9-170170 | | 6/1997 |
| JP | 11-107034 | | 4/1999 |
| JP | 2002-161114 | | 6/2002 |
| JP | 2002-266173 | | 9/2002 |
| JP | 2002-371437 | | 12/2002 |
| JP | 2002-371438 | | 12/2002 |
| JP | 2004-091961 | | 3/2004 |
| JP | 2004-197278 | | 7/2004 |
| JP | 2007-269822 | | 10/2008 |
| WO | 2004/035679 | | 4/2004 |
| WO | WO 2008/047745 | | 4/2008 |

OTHER PUBLICATIONS

Huang et al., "Effect of fibre microstructure upon the modulus of PAN- and pitch-based carbon fibres," 1995, Carbon, vol. 33, Issue 2, pp. 97-107.*

Akinari Minegishi et al., "The effect of ultrahigh molecular weight polymers on the nonlinear response in uniaxial elongational viscosity," *Journal of the Society of Rheology*, vol. 25, No. 4 (1997), pp. 215-216.

* cited by examiner

*Primary Examiner* — William Cheung
(74) *Attorney, Agent, or Firm* — DLA Piper LLP (US)

(57) ABSTRACT

A carbon fiber precursor fiber having a weight average molecular weight $M_w(F)$ of 200,000 to 700,000 and a degree of polydispersity $M_Z(F)/M_w(F)$, wherein $M_Z(F)$ indicates Z-average molecular weight of the fiber, of 2 to 5.

6 Claims, No Drawings

CARBON-FIBER PRECURSOR FIBER, CARBON FIBER, AND PROCESSES FOR PRODUCING THESE

RELATED APPLICATIONS

This is a §371 of International Application No. PCT/JP2009/057332, with an international filing date of Apr. 10, 2009, which is based on Japanese Patent Application No. 2008-103207 filed Apr. 11, 2008, the subject matter of which is incorporated by reference.

TECHNICAL FIELD

The present invention relates to a high-grade carbon fiber precursor fiber which is superior in passage stability in a process for producing a carbon fiber, and a process for producing the carbon fiber precursor fiber, as well as a high-performance and high-grade carbon fiber using the carbon fiber precursor fiber and a process for producing the carbon fiber.

BACKGROUND ART

Since carbon fibers have a higher specific strength and specific modulus as compared with other fibers, the carbon fibers have also been widely applied, as reinforcing fibers for composite materials, to general industrial uses such as for automobile, civil engineering and architecture, compressed container and wind turbine blade, in addition to conventional sporting goods applications and aerospace space applications, and both further improvement in productivity and enhanced performance have been highly demanded.

Among the carbon fibers, a polyacrylonitrile (which may be hereinafter abbreviated as PAN)-based carbon fiber, which is most widely used, is industrially produced in such a way that a spinning solution composed of a PAN-based polymer, which is a precursor of the fiber, is subjected to a wet spinning, dry spinning or a dry-wet spinning to obtain a carbon fiber precursor fiber (which may be hereinafter abbreviated as a precursor fiber), the carbon fiber precursor fiber is then converted to a oxidized fiber by heating under an oxidizing atmosphere at a temperature of 200 to 400° C., and the oxidized fiber is carbonized by heating under an inert atmosphere at a temperature of at least 1,000° C.

In order to obtain a high-performance carbon fiber, the tension or draw ratio of a fiber bundle is often set higher in the production process described above. However, as the draw ratio or tension is increased, generation of fuzz or fiber breakage occurs more often. When the generation of fuzz or fiber breakage occurs, the grade and quality are decreased, dropped fuzz or broken fibers is wound around a roller or deposited in a furnace, and more likely to damage a subsequent fiber bundle. Thus, for stable production, there is a problem that it is not possible to set a high draw ratio enough to obtain a high-performance fiber, and the production has to be handled at a temporizing draw ratio in the trade-off relationship. In particular, techniques have been proposed for aiming at stabilization of drawing by allocating a profile for drawing in accordance with the progress of a heat resistance imparting reaction in a oxidation step (see Patent Document 1 and Patent Document 2). However, these patent documents only present the selection of the temporizing draw ratio as described above, and fail to disclose any techniques for allowing high draw ratios to be set fundamentally in a oxidation step, and if the temporizing draw ratio as described above is selected to handle the production on the basis of the documents, fiber breakage is not able to be sufficiently reduced.

On the other hand, the improvement in productivity of the PAN-based carbon fiber has been examined in terms of any of making, oxidizing, or carbonizing carbon fiber precursor fibers. Above all, conventional techniques concerning improvement in productivity of precursor fibers have the following problem. More specifically, in producing precursor fibers, the productivity is subjected to constraints by the number of spinneret holes, the limit velocity of taking up coagulated fibers according to the properties of the PAN-based polymer solution, and the limited draw ratio (which may be referred to as a limited draw ratio) related to the coagulated structure (hereinafter, the property indicating the limit velocity of taking up coagulated fibers is referred to as spinnability). Specifically, for obtaining carbon fiber precursor fibers composed of a large number of single fibers, the conditions influencing the productivity have to be determined depending on how much the final producing-precursor-fibers velocity determined by the product of the spinning speed and the draw ratio is increased. More specifically, when the spinning speed is increased in order to improve the productivity, the drawability is decreased, and the production process is thus likely to be destabilized. On the other hand, when the spinning speed is decreased, the production process is stabilized while the productivity is decreased. Thus, there has been a problem that it is difficult to achieve both improvement in productivity and stabilization of the production process.

Since it is known regarding the problem described above that the spinning method has a significant influence on spinnability, an explanation will be given for each spinning method.

In a wet spinning method, a spinning solution is extruded from a spinneret hole in a coagulation bath to the coagulation bath. Thus, coagulation proceeds immediately after the spinning solution is extruded from the spinneret hole. Therefore, the substantial draft ratio at spinning is increased with increase in taking up velocity. The increase in draft at spinning causes fiber breakage at a spinneret surface, and there is thus a limit on the increase in taking up velocity.

In contrast, in a dry-wet spinning method, a spinning solution is extruded once into the air (air gap), and then introduced into a coagulation bath, and yarn is thus mostly drawn at a low tension in the air gap. Therefore, it is known that the substantial draft at spinning in the coagulation bath is reduced to increase the spinnability. For example, a technique has been proposed in which the polymer concentration of the spinning solution is controlled to reduce the viscosity of the spinning solution, promote the handleability in filtration operation, and improve the draft ratio at spinning, which is the ratio between the velocity of taking up fibers in the coagulation bath and the extrusion velocity of a spinning solution from a spinneret (see Patent Document 3). According to this proposal, while an improvement effect is recognized as the draft ratio at spinning is 10, the draft ratio at spinning is only increased by the increased hole diameter of the spinneret. More specifically, the increased hole diameter of the spinneret slows down the linear extrusion velocity to increase the draft ratio at spinning. However, it is not possible to improve the productivity of the precursor fiber, because the spinnability is not improved only by the increase in draft ratio at spinning.

While a technique has been proposed in which the draft ratio at spinning is set at 5 to 50 by using a high-velocity spinning solution and providing a specific air gap (see Patent Document 4), this proposal relates to an acrylic fiber for closing, in which the number of substantial single fibers forming a fiber bundle is as small as 36, and is thus not suitable for carbon fibers obtained by oxidizing and carbonizing fiber bundles composed of a large number of, several thousand to hundreds of thousands of single fibers.

More specifically, in each of the conventionally known methods, the effect of improvement in productivity is limited. Accordingly, there has been demand for techniques for improving the productivity of carbon fibers, which can increase both the spinnability and the limited draw ratio even in the case of fiber bundles composed of a large number of single fibers, and further can suppress the generation of fuzz or fiber breakage which decreases the quality and grade and further the stability in production even in the case of using oxidation conditions including a high draw ratio.

The fact that little fuzz as carbon fibers have not only the advantage of process stability in a prepreg production process and a composite production process, but also the high incidence of the composite compressive strength for a molded body molded with the use of the carbon fibers, because fiber misalignment due to fuzz and the like can be reduced. The meaning of achieving carbon fibers with little fuzz is significant, because the compressive strength is an important index for material design in the design of composites.

The cause of such fuzz is considered to be partly a lattice defect of a hexagonal carbon layer. It is possible in principle to evaluate the lattice defect of the hexagonal carbon layer with the use of a Raman spectrum. While there have been conventionally a lot of study examples for the evaluation of carbon fibers with the use of a Raman spectrum (see Patent Documents 5 and 6), many studies regarding crystallite structures have been carried out whereas no discussion has been made regarding lattice defects. In addition, in the techniques disclosed in these documents, the crystallite structure of the carbon fibers is only controlled on the basis of the evaluation, and no lattice defect is controlled. Therefore, while the techniques for improving the average values for properties have been disclosed, no technique for improving variations in properties has been disclosed.

In addition, the cause of fuzz will be considered while focusing attention on carbon fiber bundles. Since fuzz is generated by breakage of weak fibers, the magnitude of variation in strength is related to the number of fuzzes. The variation in strength for carbon fibers is indicated by Weibull parameters (a Weibull shape parameter and a scale parameter) in many cases, and the variation in mechanical properties of carbon fibers as a resin impregnated strand is slightly improved in the case of a composite material formed with the use of carbon fibers which have the same mechanical properties of carbon fibers as a resin impregnated strand and is different in Weibull shape parameter. However, no example of significant improvement in average value for the physical properties is known. For example, carbon fibers have been proposed which have a single fiber tensile strength distribution specified by a Weibull shape parameter (see Patent Documents 7 and 8). In Patent Document 7, in order to suppress fuzz which may be generation in a graphitization process, the single fiber tensile strength distribution for carbon fibers which have a tensile modulus of carbon fibers as a resin impregnated strand of 305 GPa before the graphitization process is controlled to be narrow (have a Weibull shape parameter of 5 to 6). In accordance with this technique, the improvement of the tensile modulus of carbon fibers as a resin impregnated strand leads to brittle fracture morphology, and stress concentration is thus more likely to occur. Thus, the properties are more likely to be affected by defects, resulting in a decrease in Weibull shape parameter. In addition, in Patent Document 8, carbon fibers are proposed which are suitable for filament taking up processing and excellent in opening properties. Patent Document 8 mentions that the cross sectional shape and surface morphology of fibers are made more appropriate, the passage through the process for processing is improved without a large amount of converging agent, and it is important to control the Weibull shape parameter to be 4 to 6 in order to the improved passage. However, the modulus is 270 GPa or less, and the balance between a high modulus and a narrow variation in single fiber strength has not been achieved.

Patent Document 1: Japanese Patent Application Laid-Open No. 62-257422

Patent Document 2: Japanese Patent Application Laid-Open No. 58-186614

Patent Document 3: Japanese Patent Application Laid-Open No. 64-77618

Patent Document 4: Japanese Patent Application Laid-Open No. 11-107034

Patent Document 5: Japanese Patent Application Laid-Open No. 3-180514

Patent Document 6: Japanese Patent Application Laid-Open No. 9-170170

Patent Document 7: Japanese Patent Application Laid-Open No. 4-222229

Patent Document 8: Japanese Patent Application Laid-Open No. 2002-266173

It could thus be helpful to provide a process for producing a precursor fiber for a high-grade carbon fiber which is less likely to cause fuzz without imparting the productivity. In addition, it could be helpful to provide a carbon fiber precursor fiber in which a high-grade and high quality carbon fiber can be produced without imparting the productivity while suppressing fuzz and fiber breakage even under oxidation-carbonization conditions including a high tension or draw ratio.

SUMMARY

We thus provide a carbon fiber precursor fiber having the following configuration. More specifically, the carbon fiber precursor fiber according to the present invention is a carbon fiber precursor fiber which has a weight average molecular weight $M_w(F)$ of 200,000 to 700,000 for a fiber and a degree of polydispersity $M_Z(F)/M_w(F)$ ($M_Z(F)$ indicates the Z-average molecular weight of the fiber) of 2 to 5.

In addition, we provide a process for producing a carbon fiber precursor fiber according to the present invention has the following configuration. More specifically, the process for producing a carbon fiber precursor fiber according to the present invention is a process for producing a carbon fiber precursor fiber, in which a spinning solution is subjected to spinning to obtain a swelling fiber, the spinning solution made by dissolving in a solvent a polyacrylonitrile-based polymer having a weight average molecular weight $M_w(P)$ of 200,000 to 700,000 and a degree of polydispersity $M_Z(P)/M_w(P)$ ($M_Z(P)$ indicates the Z-average molecular weight of a polymer in the spinning solution) of 2.7 to 6 at a concentration of 5 wt % or more and less than 30 wt %, and the swelling fiber is subjected to a first drawing step and a dry heat treatment to obtain the carbon fiber precursor fiber according described above.

Furthermore, we provide a process for producing a carbon fiber according to the present invention having the following configuration. More specifically, the process for producing a carbon fiber is a process for producing a carbon fiber, in which the carbon fiber is obtained sequentially through a oxidation step of imparting heat resistance to the carbon fiber precursor fiber while carrying out drawing at a draw ratio of 0.8 to 3 in the air at a temperature of 200 to 300° C., a preliminary carbonization step of preliminarily carbonizing the fiber obtained in the oxidation step, while carrying out drawing at a draw ratio of 1 to 1.3 in an inert atmosphere at a temperature of 300 to 800° C., and a carbonization step of carbonizing the fiber obtained in the preliminary carbonization step, while carrying out drawing at a draw ratio of 0.96 to 1.05 in an inert atmosphere at a temperature of 1,000 to 3,000° C.

In addition, we provide a carbon fiber according to the present invention having the following configuration. More specifically, the carbon fiber according to the present invention is a carbon fiber in which a crystallite size (Lc (nm)) and parameters ($I_D/I_G$, $I_V/I_G$, $\nu_G$ ($cm^{-1}$)) concerning a carbon fiber surface satisfy the following formulas (1) to (4), the parameters determined by Raman spectroscopy.

$$1.5 \leq Lc \leq 2.6 \quad (1)$$

$$0.5 \leq I_D/I_G \leq 1 \quad (2)$$

$$0.4 \leq I_V/I_G \leq 0.8 \quad (3)$$

$$1{,}605 \leq \nu_G + 17(I_V/I_G) \leq 1{,}610 \quad (4)$$

Advantageous Effect of the Invention

According to the present invention, a precursor fiber for a high-grade carbon fiber which is less likely to cause fuzz can be produced without imparting the productivity. In addition, a high-grade and high-quality carbon fiber can be produced without imparting the productivity while suppressing fuzz and fiber breakage even under oxidation-carbonization conditions including a high tension or draw ratio.

BEST MODE FOR CARRYING OUT THE INVENTION

The inventors have already proposed a technique for producing a carbon fiber precursor fiber which provides excellent spinnability with the use of a PAN-based polymer with a specific molecular weight distribution (Japanese Patent Application No. 2007-269822). The inventors have further considered the production technique to find out that excellent production stability is provided in an oxidation step by reducing the change in the molecular weight distribution of the precursor fiber with respect to the molecular weight distribution of the PAN-based polymer in a spinning solution, and then achieved the present invention.

It is to be noted that in the present invention, a weight average molecular weight, a Z-average molecular weight, and a Z+1-average molecular weight, a number average molecular weight are abbreviated as symbols $M_w$, $M_Z$, $M_{Z+1}$, and Mn, respectively, and a suffix (F) and a suffix (P) are added when the symbols refer to all of PAN-based polymers constituting fibers and to all of PAN-based polymers in a spinning solution, respectively, to be distinguished from the symbols $M_w$, $M_Z$, $M_{Z+1}$, and $M_n$.

A precursor fiber according to the present invention is composed of a PAN-based polymer which has a weight average molecular weight $M_w(F)$ of 200,000 to 700,000, preferably 300,000 to 500,000. When the precursor fiber is composed of a lower molecular weight PAN-based polymer which has $M_w(F)$ less than 200,000, the strength of the precursor fiber is decreased, easily resulting in the generation of fuzz in an oxidation step. Alternatively, when the precursor fiber is composed of a higher molecular weight PAN-based polymer which has $M_w(F)$ greater than 700,000, it is necessary to adjust the weight average molecular weight $M_w(P)$ of the polymers in the spinning solution so as to exceed 700,000. In such a case, increased entanglement of molecular chains results in difficulty in stretching, and thus reduces the stretched chain length. Therefore, it is not possible to achieve the advantageous effects of the present invention. While the $M_w(F)$ is equal to or lower than $M_w(P)$, the $M_w(F)$ can be controlled by the conditions in the spinning step. This will be described in detail later.

In addition, the PAN-based polymer constituting the precursor fiber according to the present invention preferably has a degree of polydispersity $M_Z(F)/M_w(F)$ ($M_Z$ indicates Z-average molecular weight of the fiber) of 2 to 5, preferably 2.5 to 5, more preferably 3 to 5, and even more preferably 3.5 to 5.

In the present invention, the weight average molecular weight $M_w(F)$, Z-average molecular weight $M_Z(F)$, and number average molecular weight Mn(F) of the fiber, and the weight average molecular weight $M_w(P)$, Z-average molecular weight $M_Z(P)$, Z+1-average molecular weight $M_{Z+1}(P)$, and number average molecular weight Mn(P) of the PAN-based polymer in spinning are measured by the gel permeation chromatography method (hereinafter, abbreviated by GPC method), and shown as a value in terms of polystyrene. It is to be noted that the degree of polydispersity $M_Z/M_w$ has the following meaning, whether the fiber or the PAN-based polymer. More specifically, the number average molecular weight Mn is sensitive to reflection of the contribution of a low molecular weight substance contained in a polymer compound. In contrary, $M_w$ reflects the contribution of a high molecular weight substance, $M_Z$ is further sensitive to reflection of the contribution of the high molecular weight substance, and $M_{Z+1}$ is much more sensitive than $M_Z$ to reflection of the contribution of the high molecular weight substance. Therefore, the molecular weight distribution $M_w$/Mn and the degrees of polydispersity $M_Z/M_w$ and $M_{Z+1}/M_w$ can be used to evaluate the facet of the extent of the molecular weight distribution. The $M_w$/Mn of 1 indicates monodispersity, and the increase of the $M_w$/Mn means that the molecular weight distribution is broader around the low molecular weight side. On the other hand, the increase of the $M_Z/M_w$ means that the molecular weight distribution is broader around the high molecular weight side. In particular, the $M_{Z+1}/M_w$ is significantly increased, in such a case that two types of polymers are mixed which significantly differ from each other in $M_w$.

As described above, the facet of the molecular weight distribution indicated by the $M_w$/Mn is different from that indicated by the $M_Z/M_w$. Thus, even when the $M_w$/Mn is increased, it is not always true that the $M_Z/M_w$ is increased in a similar way.

In the present invention, $M_w$ of 200,000 to 700,000 is defined as a normal molecular weight, whereas $M_w$ of 800,000 to 15,000,000 is defined as an ultrahigh molecular weight.

While the mechanism that achieves the effect of inhibiting the generation of fuzz in the oxidation step through the use of the precursor fiber according to the present invention has not been specified at this stage, the mechanism is estimated as follows. It is conventionally known that it would be possible in principle to produce high-strength and high-modulus PAN-based fibers by the means of highly drawing a PAN-based polymer with a ultrahigh molecular weight to form a stretched chain of PAN-based polymer molecules in the PAN-based fiber and reduce amorphous moieties and molecular chain terminals in the PAN-based fiber, in the same way as other organic fibers typified by a polyethylene fiber. However, in order to introduce the principle effectively, the control is required for reducing entanglement of the PAN-based polymer in a solution of the PAN-based polymer, and for the purpose, the concentration of the PAN-based polymer needs to be lowered. When the concentration of the PAN-based polymer is lowered, the productivity is decreased because the step of controlling the solvent is complicated. In addition, when flame resistance is to be imparted to the PAN-based fiber in the form a fiber bundle composed of single fibers, a very small percentage of the single fibers are fractured due to strength fluctuation among the single fibers, thereby generating fuzz. On the other hand, the PAN-based polymer with an ultrahigh molecular weight takes a longer time for molecules transformed by stretching or the like to return to the original shape, so-called relaxation time, than a PAN-based polymer with a normal molecular weight. Thus, a small amount of ultrahigh molecular weight PAN-based polymer contained in the PAN-based polymer solution preferentially draws the ultrahigh molecular weight PAN-based polymer to form a so-called stretched chain. In the case of the obtained precursor fiber with the stretched PAN-based fiber containing the small amount of ultrahigh molecular weight PAN-based polymer, when a tensile stress is applied to the precursor fiber, the stretched chain of molecules of the high-strength and high-modulus ultrahigh molecular weight PAN-based polymer in the precursor fiber acts as if it were a filler, and when the oriented normal PAN-based polymer (the matrix in relation to the filler) comes close to be fractured, the value of fracture toughness is increased for the following reasons (A) to (C): (A) the fracture is progressed while bypassing the stretched chain of the ultrahigh molecular weight PAN-based polymer; (B) the stretched chain of the ultrahigh molecular weight PAN-based polymer bears stress to bear the fracture energy; and (C) molecules of the ultrahigh molecular weight PAN-based polymer are pulled out. Thus, it is believed that single fibers which have low fracture elongation are eliminated from the fiber bundle, thereby reducing the generation of fuzz in the oxidation step.

A method for controlling the $M_Z(F)/M_w(F)$ as described above will be described. In the present invention, a PAN-based polymer solution with a PAN-based polymer dissolved in a solvent is used as a spinning solution, in which the PAN-based polymer has a weight average molecular weight $M_w(P)$ of 200,000 to 700,000, preferably 300,000 to 500,000. In the case of using a low molecular weight PAN-based polymer solution with $M_w(P)$ less than 200,000, the molecular weight is not increased in the process for producing the precursor fiber, and the $M_w(F)$ is thus less than 200,000, resulting in the inability to obtain a precursor fiber for carbon fibers with excellent productivity. More specifically, in the case of using a low molecular weight PAN-based polymer solution with $M_w(P)$ less than 200,000, the strength of the obtained precursor fiber is decreased with the result that fuzz is likely to occur in the oxidation step. In addition, while the $M_w(P)$ is preferably higher, a high molecular weight PAN-based polymer with the $M_w(P)$ more than 700,000 has more entanglement. Thus, by drawing, the molecular chain may not be sufficiently stretched. It is to be noted that while for the purpose of merely increasing the stretched chain length, it is possible to obtain the carbon fiber precursor fiber as defined in claim 1 by lowering the polymer concentration to obtain a semidilute solution with entanglement reduced and carrying out stretching, it is not possible to achieve high productivity for the precursor fiber, which is another object of the present invention. In this case, the $M_w(P)$ can be controlled by changing the amounts of a monomer, a polymerization initiator, a chain transfer agent, etc., during polymerization for the PAN-based polymer.

The degree of polydispersity of $M_Z(P)/M_w(P)$ of the PAN-based polymer in the spinning solution is 2.7 to 6, preferably 3 to 5.8, and more preferably 3.2 to 5.5. The $M_Z(P)/M_w(P)$ less than 2.7 results in loss of strain hardening as will be described later, and lack of improvement in stability of extrusion of the PAN-based polymer from a spinneret. On the other hand, the $M_Z(P)/M_w(P)$ more than 6 increases entanglement too much, resulting in the difficulty in extrusion from the spinneret. A component with a higher molecular weight in the PAN-based polymer solution is preferentially oriented in the spinning step, and bears stress such as a drawing tension. When the stress exceeds the bonding energy of a molecular chain, the molecular chain is fractured, and the peak on the high molecular weight side in the molecular weight distribution is likely to be reduced because the fracture of the molecular chain preferentially occurs in a component with a higher molecular weight in the PAN-based polymer solution. Accordingly, the $M_Z/M_w$ may be decreased, but is not increased in the spinning step, and needs to be set to be $M_Z(F)/M_w(F)$ of the precursor fiber or more. From these observations, the use of a solution of the PAN-based polymer as defined in the present invention has made it possible to produce a precursor fiber according to the present invention on an industrially successful level of scale for the first time.

In addition, the PAN-based polymer in the spinning solution preferably has both $M_{Z+1}(P)$ of 3,000,000 to 10,000,000 and the degree of polydispersity $M_{Z+1}(P)/M_w(P)$ of 6 to 25. The $M_{Z+1}(P)$ is more preferably 4,000,000 to 9,000,000, and even more preferably 5,000,000 to 8,500,000. In addition, the $M_{Z+1}(P)/M_w(P)$ is more preferably 7 to 17, and even more preferably 10 to 15.

The $M_{Z+1}(P)/M_w(P)$ is an index reflected in a high molecular weight substance more strongly than the $M_Z(P)/M_w(P)$, and even when a component with a high molecular weight is fractured in the spinning step, the high molecular weight substance may often remain as a component with a high molecular weight in the precursor fiber. As long as the $M_{Z+1}(P)$ falls within the range of 3,000,000 to 10,000,000, the $M_{Z+1}(P)/M_w(P)$ of 6 or more produces sufficient strain hardening, resulting in a sufficient effect of improvement in stability of extrusion of a spinning solution containing the PAN-based polymer (the strain hardening will be described later). In addition, when the $M_{Z+1}(P)/M_w(P)$ is excessively large, the strain hardening as described later is too strong, which may result in lack of the effect of improvement in stability of extrusion of a spinning solution containing the PAN-based polymer. As long as the $M_{Z+1}(P)$ falls within the range of 3,000,000 to 10,000,000, the $M_{Z+1}(P)/M_w(P)$ of 25 or less can achieve sufficient stability of extrusion of a spinning solution containing the PAN-based polymer. In addition, when the $M_{Z+1}(P)/M_w(P)$ falls within the range of 6 to 25, the $M_{Z+1}$ less than 3,000,000 may result in lack of the strength of the obtained precursor fiber, and the $M_{Z+1}(P)$ greater than 10,000,000 may result in the difficulty in extrusion of a spinning solution containing the PAN-based polymer from a spinneret.

In addition, in the molecular weight distribution, it is preferable to use a PAN-based polymer with a content ratio of 1 to 4% for components which have a molecular weight 5 times or more as high as $M_w(P)$. When the content ratio of molecular weights 5 times or more as high as $M_w(P)$ is less than 1%, the strain hardening as described later may be weak, resulting in insufficient improvement in the stability of extrusion of a spinning solution containing the PAN-based polymer from a spinneret. When the concentration ratio is greater than 4%, the strain hardening as described later may be too strong, resulting in insufficient improvement in the stability of extrusion of the PAN-based polymer. From this point of view, the content ratio of molecular weights 5 times or more as high as $M_w(P)$ is preferably 1.2 to 3.8%, and more preferably 1.5 to 3.6%. The content ratio of components which have a molecular weight 5 times or more as high as $M_w(P)$ can be obtained from the logarithm of molecular weights in terms of polystyrene, which is measured by the GPC method, and a molecular weight distribution curve drawn by the refractive index difference, and is defined by the ratio of the value of integral for a peak area corresponding to molecular weights 5 times or more as high as the molecular weight in terms of polystyrene to the value of integral for the entire molecular weight distribution. The refractive index difference nearly corresponds to the weight of molecules eluted per unit time, and the value of integral for the peak area nearly corresponds to the weight mix ratio.

While the mechanism that can produce a carbon fiber precursor fiber which can achieve a balance between improvement in productivity and stabilization through the use of the PAN-based polymer as described above has not been specified at this stage, the mechanism is estimated as follows. More specifically, in the process for producing a carbon fiber precursor fiber according to the present invention, when the PAN-based polymer solution containing the ultrahigh molecular weight PAN-based polymer is subjected to elongational deformation to get thinner immediately after extrusion from a spinneret hole, the ultrahigh molecular weight PAN-based polymers and the low molecular weight PAN-based polymers are entangled with each other, rapid increase in the elongation viscosity, that is, so-called strain hardening is produced mainly due to increased tensions of the molecular chains between the entangled ultrahigh molecular weight PAN-based polymers. The elongation viscosity of thinner moiety is increased with the decrease in thickness of the solution of the PAN-based polymer immediately after extrusion from a spinneret hole to stabilize the fluidity, thereby allowing the spinning speed to be increased. In the solution of the PAN-based polymer for use in the present invention, relatively lower molecular weight PAN-based polymers have highly fluid molecular chains, and thus are less likely to be oriented, whereas the orientation effect of the ultrahigh molecular weight PAN-based polymers is expressed. Thus, the use of the process for producing a carbon fiber precursor fiber according to the present invention produces a pronounced effect of improvement in spinnability several tens times or more as much as a case without the use of the method.

In addition, the smaller $M_w(P)/Mn(P)$ results in a lower content of low molecular weight components containing a number of molecular chain ends per weight which are likely to cause lattice defects in a carbon fiber obtained by oxidation-carbonization of the obtained carbon fiber precursor fiber. From this point of view, the smaller $M_w(P)/Mn(P)$ is preferable, and the $M_w(P)/Mn(P)$ is preferably smaller than the $M_Z(P)/M_w(P)$. More specifically, while the molecular weight distribution which is even broad toward the both of the higher molecular weight side and lower molecular weight side leads to a small decrease in stability of extrusion of the PAN-based polymer solution from a spinneret hole, it is preferable that the low molecular weight side be as sharp as possible (more specifically, the content of low molecular weight PAN-based polymers is low) from the standpoint that the generation of lattice defects is suppressed in a carbon fiber obtained by oxidation-carbonization of the obtained carbon fiber precursor fiber, and the $M_Z(P)/M_w(P)$ is more preferably at least 1.5 times or more, and further preferably at least 1.8 times or more as large as the $M_w(P)/Mn(P)$. According to the consideration by the inventors, when a polyacrylonitrile-based polymer is produced by radical polymerization such as an aqueous suspension or solution polymerization method, the molecular weight distribution of the polymer tails its stirs toward the low molecular weight side, and the $M_w(P)/Mn(P)$ is thus typically greater than the $M_Z(P)/M_w(P)$. Therefore, in order to obtain a solution of a PAN-based polymer with the molecular weight distribution described above for use in a process for producing a carbon fiber precursor fiber according to the present invention, a method in which polymerization is carried out under specified conditions such as use of the type, ratio, and stepwise addition of a polymerization initiator, or a method in which two kinds or more of PAN-based polymers which are produced through the use of general radical polymerization and have different molecular weight distributions from each other are blended can be employed. Of these methods, the latter method is simple in which PAN-based polymers which have different molecular weight distributions from each other are blended. In this case, a smaller number of types blended is simpler, and two kinds of PAN-based polymers are often sufficient from the standpoint of stability in extrusion.

As for the $M_w$ for the blended polymers, assuming that the PAN-based polymer with higher $M_w$ is referred to as an A component whereas the PAN-based polymer with lower $M_w$ is referred to as a B component, the $M_w$ of the A component is preferably 800,000 to 15,000,000, and more preferably 1,000,000 to 5,000,000, whereas the $M_w$ of the B component is preferably 150,000 to 700,000. The larger the difference in $M_w$ is between the A component and the B component, the more the $M_Z/M_w$ and $M_{Z+1}/M_w$ for the blended polymers tend to be increased preferably. However, when the $M_w$ of the A component is greater than 15,000,000, the productivity of the A component may be decreased, and when the $M_w$ of the B component is less than 150,000, the strength of the precursor fiber may be insufficient.

Specifically, the ratio between the A component and the B component in terms of the weight average molecular weight is preferably 2 to 45, and more preferably 20 to 45.

In addition, the ratio by weight between the A component and the B component for the blending is preferably 0.003 to 0.3, more preferably 0.005 to 0.2, ant even more preferably 0.01 to 0.1. The ratio by weight less than 0.003 between the A component and the B component for the blending may result in insufficient strain hardening, while the ratio by weight greater than 0.3 may increase the viscosity too much during extrusion of the polymer solution from a spinneret, thereby resulting in difficulty in extrusion. The ratio between the A component and the B component in terms of weight average molecular weight and the ratio by weight between the A component and the B component for the blending are measured by GPC. More specifically, the ratios are measured in such a way that the peak of the molecular weight distribution obtained by GPC is divided into a shoulder or a peak section to calculate $M_w$ for each of the A and B components and the area ratio between the peaks of the A and B components.

In the case of blending the polymers of the A component and B component, the following methods (D) to (G) can be employed: that is, (D) a method in which the both polymers are mixed and then diluted with a solvent; (E) a method in which the polymers diluted in solvents are mixed with each other; (F) a method in which the A component which is a higher molecular weight substance is diluted in a solvent, followed by mixing and dissolving the B component; and (G) a method in which the A component which is a higher molecular weight substance dissolved in a solvent and a monomer which is a raw material for the B component are mixed to carry out solution polymerization of the monomers for blending. As a mixing method for use in these methods, the following methods can be preferably employed: a method of stirring in a mixing vessel; a method of determining the quantity with the use of a gear pump and mixing with the use of a static mixer; and a method of using a twin screw extruder. From such a standpoint that the higher molecular weight substance is homogeneously dissolved, the method is preferable in which the A component which is a higher molecular weight substance is first dissolved. In particular, in the case of using the polymers for the production of a carbon fiber precursor, the dissolved state of the A component which is a higher molecular weight is extremely important, and if even a slight amount of undissolved matter is present, the undissolved matter is recognized as a contaminant, and filtered by a filter material or may form voids within the carbon fiber when the undissolved matter is too small to be filtered.

In the methods (F) and (G) described above, specifically, the polymer concentration of the A component with respect to a solvent is adjusted to be 0.1 to 5 wt %, and the A component is then mixed with the B component or a raw material monomer for the B component to carry out polymerization. The polymer concentration of the A component is more preferably 0.3 to 3 wt %, and even more preferably 0.5 to 2 wt %. The polymer concentration of the A component with respect to the solvent herein is defined as the polymer concentration of the A component in a solution, assuming that the solution is composed of only the A component and the solvent. Preferably, the polymer concentration of the A component is, more specifically, the concentration of a semidilute solution of a collection of polymer molecules slightly overlapped. When the A component is mixed with the B component or a monomer constituting the B component to carry out polymerization, the mixed state is likely to be homogeneous. Thus, it is a further preferable embodiment to bring the polymer concentration of the A component into the concentration of a dilute solution of isolated chains. Since the concentration for the dilute solution is considered to be determined by the intermolecular excluded volume which is determined by the molecular weight of the polymer and the solubility of the polymer with respect to the solvent, although it cannot be categorically decided, but it is preferable that the concentration largely fall within the above-mentioned range in the present invention. If the above-mentioned polymer concentration is greater than 5 wt %, an undissolved matter from the A component may be present. On the other hand, if the polymer is less than 0.1 wt %, the solution has already been a dilute solution although it also depends upon the molecular weight, and the effect has been thus often saturated.

In the present invention, as described above, the method in which, after the polymer concentration of the A component to solvent is controlled into preferably 0.1 to 5 wt %, the B component is mixed and dissolved therewith is acceptable. In view of simplifying the process, the method is more preferable in which a high molecular weight substance diluted with a solvent is mixed with the raw material monomer for the B component to carry out solution polymerization of the monomer.

As a method for bringing the polymer concentration of the A component with respect to the solvent into 0.1 to 5 wt %, a method involving dilution or a method involving polymerization may be employed. In the case of dilution, it is important to stir the solution until the solution can be homogeneously diluted, and the dilution temperature is preferably 50 to 120° C., and the dilution period may be appropriately set depending on the dilution temperature or the concentration before the dilution. In case of the dilution temperature less than 50° C., the dilution may takes a long period of time, while in case of the dilution temperature greater than 120° C., there is possibility that the A component may be altered. In addition, from the standpoints of reduction in overlapping of polymer molecules and of homogeneous mixing, it is preferable to control the polymer concentration of the A component with respect to the solvent to be a range of 0.1 to 5 wt % from the production of the above-mentioned A component to the start of mixing with the above-mentioned B component, or until starting polymerization of the raw material monomer for B component. Specifically, it is preferable to employ a method in which, when the A component is produced by solution polymerization, the polymerization is stopped at a polymer concentration of 5 wt % or less with respect to the solvent, followed by mixing with the B component or the raw material monomer for the B component for the polymerization of the monomer. Typically, when the ratio of the monomer fed to the solvent is low, it is often difficult to produce a high molecular weight substance by solution polymerization. In order to solve this problem, the ratio of the fed monomer is typically increased, but at the stage of a polymer concentration of 5 wt % or less, a large amount of unreacted monomer will remain in the system. The B component may be additionally mixed into the system after removing the unreacted monomer by volatilization, but from the viewpoint of simplification of the process, it is preferable to use the unreacted monomer for solution polymerization of the B.

The A component preferably used in the present invention is desirably compatible with PAN, and is preferably a PAN-based polymer from the standpoint of compatibility. The composition of the A component preferably has an AN concentration of 93 to 100 mol %, and more preferably 98 to 100 mol % with respect to all of the monomers. A monomer which can be copolymerized with AN may be copolymerized at 7 mol % or less. In this case, when a copolymerizable component is used which has a smaller chain transfer constant than the AN, it is preferable to reduce the amount of the copolymerizable component as much as possible.

As monomers which can be copolymerized with AN, for example, acrylic acid, methacrylic acid, itaconic acid and alkali metal salts, ammonium salt and lower alkyl esters thereof, acrylamide and derivatives thereof, allyl sulfonic acid, methallyl sulfonic acid and salts or alkyl esters thereof, etc., can be used.

In the present invention, as the polymerization process for producing the PAN-based polymer which is the A component, a solution polymerization method, a suspension polymerization method, an emulsion polymerization method, etc., can be selected. For the purpose of homogeneous polymerization of AN and the copolymerizable component, it is preferable to employ a solution polymerization method. In the case in which a solution polymerization method is used for the polymerization, a solvent in which PAN is soluble, such as an aqueous solution of zinc chloride, dimethyl sulfoxide, dimethyl formamide and dimethyl acetamide, is preferably used, for example, such as an aqueous solution of zinc chloride, dimethyl sulfoxide, dimethyl formamide and dimethyl acetamide. In a case in which it is difficult to obtain required $M_w$, a polymerization method using a solvent which has a low chain transfer constant, that is, a solution polymerization method using an aqueous solution of zinc chloride or a suspension polymerization method using water is preferably used.

The ratio of AN constituting the B component preferably used in the present invention is preferably 93 to 100 mol %, and more preferably 98 to 100 mol %. While a monomer which can be copolymerized with AN may be copolymerized at 7 mol % or less, the increased amount of copolymerizable component results in thermal decomposition of the copolymerizable component in the oxidation step and in notable molecular chain scission, thereby decreasing the tensile strength of carbon fibers.

As the monomer which can be copolymerized with AN, a compound for accelerating the flame resistance can be used. For example, acrylic acid, methacrylic acid, itaconic acid and alkali metal salts, ammonium salt and lower alkyl esters thereof, acrylamide and derivatives thereof, allyl sulfonic acid, methallyl sulfonic acid and salts or alkyl esters thereof, etc., can be used as this compound.

The method for polymerization of the B component in the present invention can be selected from a solution polymerization method, a suspension polymerization method, an emulsion polymerization method, etc., and for the purpose of homogeneous polymerization of AN and the copolymerizable component, it is preferable to employ a solution polymerization method. In the case in which a solution polymerization method is used for the polymerization, a solution in which PAN is soluble, such as an aqueous solution of zinc chloride, dimethyl sulfoxide, dimethyl formamide and dimethyl acetamide, is preferably used. Above all, it is preferable to use dimethyl sulfoxide for the solution in the solution polymerization method because PAN has high solubility. The raw materials for used in the polymerization are all preferably passed through a filter material with a filtration accuracy of 1 μm or less, and then used.

The PAN-based polymer is dissolved in an organic solvent in which the PAN-based polymer is soluble, such as dimethyl sulfoxide, dimethyl formamide, and dimethyl acetamide, or in an inorganic salt solvent that is an aqueous solution of an inorganic salt, such as an aqueous solution of zinc chloride and an aqueous solution of sodium thiocyanate, thereby providing a spinning solution. In the case of using solution polymerization, the same solvent is preferably used as the polymerization solvent and the spinning solvent, because the step is eliminated of removing and separating the solvent from the PAN-based polymer obtained in the polymerization step and dissolving the separated PAN-based polymer again in the spinning solvent.

The concentration of the PAN-based polymer in the spinning solution preferably falls within the range of 5 to 30 wt %, although it is not necessarily appropriate to suggest the range on the ground that the relationship between the polymer concentration and the viscosity varies significantly depending on the solvent. In the case of an organic solvent, the concentration is more preferably 14 to 25 wt %, and most preferably 18 to 23 wt %. In the case of an inorganic salt solvent, the concentration preferably falls within the range of 5 to 18 wt %. The polymer concentration less than 5 wt % uneconomically leads to a large amount of solvent used, and may result in voids produced within the fiber during coagulation and thus degradation of the fiber properties. On the other hand, the polymer concentration greater than 30 wt % results in a decrease in viscosity, which shows the tendency of difficulty in spinning. The polymer concentration of the spinning solution can be controlled by the amount of the solvent used.

The polymer concentration in the present invention refers to percent by weight for the PAN-based polymer contained in the solution of the PAN-based polymer. Specifically, after weighing the solution of the PAN-based polymer on a scale, the weighed PAN-based polymer solution is mixed with a solvent which does not dissolve the PAN-based polymer but is compatible with the solvent used for the PAN-based polymer solution, to desolvate the PAN-based polymer, and the PAN-based polymer is then weighed. The polymer concentration is calculated by dividing the weight of the PAN-based polymer after the desolvation by the weight of the PAN-based polymer before the desolvation.

The viscosity of the PAN-based polymer solution at a temperature of 45° C. preferably falls within the range of 15 to 200 Pa·s, more preferably falls within the range of 20 to 100 Pa·s, and most preferably falls within the range of 25 to 60 Pa·s. The solution viscosity less than 15 Pa·s shows the tendency of decrease in spinnability, because spun yarn is likely to cause capillary fracture. The solution viscosity greater than 200 Pa·s makes gelation easier, which shows the tendency to obstruct the filter material. The viscosity of the spinning solution can be controlled by $M_w(P)$, the polymer concentration, the type of the solvent, etc.

In the present invention, the viscosity of the PAN-based polymer solution at a temperature of 45° C. can be measured by a B-type viscometer. Specifically, after adjusting the temperature of the PAN-based polymer solution put in a beaker by immersing the beaker in a warm water bath of which temperature is adjusted to a temperature of 45° C., the viscosity is measured by a B-type viscometer. As the B-type viscometer, for example, B8L-type viscometer produced by Tokyo Keiki Inc., is used to measure the viscosity in such a way that the viscosity of the PAN-based polymer solution in the range of 0 to 100 Pa·s is measured at a rotation speed of 6 r.p.m. for No. 4 rotor, and when the viscosity of the solution is in the range of 100 to 1,000 Pa·s, it is measured at a rotation speed of 0.6 r.p.m.

In the present invention, prior to spinning of the spinning solution, the spinning solution is preferably passed through a filter material to remove impurities mixed or generated in the polymer raw materials and in each step. The filtration accuracy of the filter material is preferably 3 to 15 μm, more preferably 5 to 15 μm, and even more preferably 5 to 10 μm. In the present invention, the filtration accuracy of the filter material is defined as a particle size (diameter) for spherical particles of which 95% can be collected during the passage through the filter material. Therefore, the accuracy of the filtration is associated with the pore size, and the filtration accuracy is generally increased by reducing the pore size. However, as the filtration accuracy is higher, the shear rate applied on the spinning solution is increased, resulting in a tendency to decrease $M_Z(F)/M_w(F)$. Thus, in the present invention, it is preferable to reduce the filtration accuracy. However, the filtration accuracy higher than 15 μm may increase contaminants in the obtained spinning solution, thereby resulting in the generation of fuzz during stretching in the oxidation-carbonization and stretching step. On the other hand, the filtration accuracy lower than 3 μm may selectively filtrate not only contaminants but also ultrahigh molecular weight components contained in the spinning solution, thereby decreasing the $M_Z(F)/M_w(F)$.

In the present invention, the carbon fiber precursor fiber can be produced by spinning the spinning solution described above in accordance a wet, dry, or dry-wet spinning method. Above all, the dry-wet spinning method is preferably used because the dry-wet spinning method brings out the properties of the PAN-based polymer in the present invention. In each case of the dry-wet spinning method and dry spinning method, spinning is carried out in accordance with a known method. However, cleavage of molecular chains mainly including ultrahigh molecular weight components may be caused depending on conditions to be set. Thus, some points to be considered will be described for the production of a precursor fiber containing ultrahigh molecular weight components.

The spinneret hole diameter used for spinning is preferably 0.04 mm to 0.4 mm, and more preferably 0.1 to 0.15 mm.

When the spinneret hole diameter is less than 0.04 mm, a shear stress is applied during extrusion from the spinneret, thereby not only losing intermolecular entanglement, but also causing cleavage of molecular chains in an extreme case, and the $M_Z(F)/M_w(F)$ may be thus decreased. On the other hand, when the spinneret hole diameter is greater than 0.4 mm, excess stretching is required in order to obtain a fiber with a single fiber fineness of 1.5 dtex or less. If such a process is carried out, cleavage of molecular chains may occur to decrease the $M_Z(F)/M_w(F)$.

In the dry-wet spinning method, it is preferable that the draft ratio at spinning for the spinning solution fall within the range of 2.5 to 15. The draft ratio at spinning preferably falls within the range of 5 to 15, and more preferably falls within the range of 10 to 15.

The draft ratio at spinning herein refers to a value obtained by dividing a surface velocity of a roller provided with a driving source first brought into contact with coagulated fibers after the coagulated fibers leaves a spinneret (taking up speed of coagulated fibers) by a linear velocity of a spinning solution in a spinneret hole (linear extrusion velocity). The draft ratio at spinning is expressed by the following formula.

Draft Ratio at Spinning=(Taking up Velocity of Coagulated Fiber)/(Linear Extrusion Velocity)

The linear extrusion velocity refers to a value obtained by the volume of the spinning solution extruded per unit time by the area of the spinneret hole. Accordingly, the linear extrusion rate is determined by the amount of the spinning solution extruded and the hole diameter of the spinneret. The spinning solution leaves the spinneret hole, then, is largely deformed in the air, and then brought into contact with a coagulation bath in which the spinning solution is gradually coagulated to coagulated fibers. Since the uncoagulated spinning solution is stretched more easily than the coagulated fibers, the deformation of the spinning solution mostly takes place in the air. The increased draft ratio at spinning makes it easier to make the fiber thinner, and allows the draw ratio to be set lower in the subsequent process for producing precursor fibers. The drawing from the state of the spinning solution is preferable because the solvent reduce entanglement of the PAN-based polymers and allows drawing to be carried out at a smaller tension as compared with drawing in the subsequent process for producing precursor fibers, and cleavage of molecular chains is less likely to occur. When the draft ratio at spinning is less than 2.5, the draw ratio in the subsequent process for producing precursor fibers has to be set higher in many cases. In addition, the draft at spinning is 15 or less, which is sufficient for suppressing decrease in $M_Z(F)/M_w(F)$.

In the present invention, it is preferable that the coagulation bath contain a solvent used as the solvent of the PAN-based polymer solution, such as dimethyl sulfoxide, dimethyl formamide and dimethyl acetamide, and a coagulation promoting component. The coagulation promoting component is preferably a component which does not dissolve the PAN-based polymer described above but is compatible with the solvent used for the PAN-based polymer solution, and specifically, water is preferably used. As the conditions of the coagulation bath, known conditions can be set to be suitable for either dry-wet spinning or wet spinning.

The PAN-based polymer solution is coagulated in the coagulation bath to form fibers (hereinafter, referred to as a swelling fiber), and the fibers is wound by the roller provided with the driving source. In order to bring out the properties of the PAN-based polymer for use in the present invention, the velocity of taking up the swelling fiber is preferably 20 to 500 m/min. The taking up velocity less than 20 m/min decreases the productivity, while the taking up velocity greater than 500 m/min inevitably increases the shear stress when the spinning solution passes through the filter material or the spinneret hole, resulting in decrease in $M_Z(F)/M_w(F)$ in some cases.

The wound swelling fiber is continuously subjected to a first drawing step and a dry heat treatment, thereby obtaining a carbon fiber precursor fiber. If necessary, after the dry heat treatment, a second drawing step may be carried out.

The first drawing step in the present invention refers to (a step of) drawing from the coagulation bath taking up roller to the dry heat treatment. The first drawing step is generally carried out in the air or a warm water bath. Typically, the solvent remaining in the coagulated fibers is removed in accordance with a water washing step, and drawing is then carried out in the bath or in the air. It is to be noted that the coagulated fibers may be drawn directly in the bath and then washed with water. In addition, the second drawing step may be skipped, or in the case of carrying out the second drawing step, dry-heat drawing or drawing in a heating medium may be employed, or the combination of dry-heat drawing and drawing in a heating medium may be employed. Typically, the drawing is generally carried out in a heating medium In the present invention, the control of the tension in the first drawing step or the second drawing step allows a carbon fiber precursor fiber with the $M_Z(F)/M_w(F)$ in the range described above to be obtained.

In the first drawing step, the tension is 1.5 to 3 mN/dtex, preferably 1.8 to 2.8 mN/dtex, and more preferably 2 to 2.8 mN/dtex. The tension increased to more than 3 mN/dtex in the first drawing step may result in the inability to carry out uniform drawing, and thus in the inability to keep the uniformity in molecular orientation, and often causes cleavage of molecular chains to decrease the $M_Z(F)/M_w(F)$. While the draw ratio has been increased in accordance with conventional findings, it is important in the present invention to the tension throughout the process for producing precursor fibers. However, the drawing tension decreased to less than 1.5 mN/dtex in the first drawing step may result in insufficient molecular orientation for a precursor fiber obtained, and thus decrease the tensile modulus of carbon fibers as a resin impregnated strand of a carbon fiber obtained.

The tension in the first drawing step can be controlled by the drawing temperature and the draw ratio, but varies depending on the type of the PAN-based polymer. In particular, since the tension is increased when the PAN-based polymer is large in $M_Z$, it is preferable to decrease the draw ratio or increase the drawing temperature. It is to be noted that the tension in the first drawing step means the maximum tension among the measurement values when the tension is measured just before a roller with respect to the travel of the fibers during the first drawing step. In the case of carrying out the first drawing step in multiple drawing bathes by dry-wet spinning, the point at which the maximum drawing tension is developed is the last bath in many cases. On the other hand, in the case of wet spinning, the point is in the vicinity of a taking up roller taken out from a coagulation bath in many cases. The tension is obtained by dividing the load on the fibers by the fineness. The load is measured by using a tension meter to sandwich running fibers. The fineness (dtex) is obtained by drying a fixed length of process fibers to be subjected to the measurement and then measuring the weight of a constant length of fibers.

The drawing temperature in the first drawing step is preferably 60 to 95° C., more preferably 65 to 85° C., and even more preferably 65 to 75° C. From the standpoint of reduction in tension, the drawing temperature is preferably higher. However, in the case of higher than 95° C., adhesion between single fibers may occur to decrease the grade. On the other hand, in the case of lower than 60° C., the drawability may be degraded to decrease the productivity. In the case of carrying out the first drawing step in multiple drawing bathes, the drawing temperature refers to the maximum bath temperature.

The draw ratio in the first drawing step refers to a value obtained by dividing the final roller rotation speed in the first drawing step by the taking up roller rotation speed taken out from the coagulation bath. The draw ratio in the first drawing step is preferably 1 to 5 times, and more preferably 1 to 3 times. While the draw ratio is preferably smaller in order to reduce the drawing tension, the draw ratio less than 1 often causes molecular orientation relaxation, resulting in products with inferiority in both strength and heat resistance in many cases. On the other hand, the draw ratio greater than 5 results in degradation of the dimensional stability in the process for producing precursor fibers and in adhesion between single fibers, thereby decreasing the yarn-making properties. Also, in the oxidation-carbonization process, fuzz is generated, thereby easily leading to property degradation.

After the first drawing step, for the purpose of preventing adhesion between single fibers, it is preferable to impart an oil agent composed of a silicone compound or the like to the fibers subjected to the first drawing step. In the case of using the silicone oil agent, it is preferable to use a silicone oil agent containing a modified silicone such as an amino-modified silicone which has high heat resistance.

The fibers subjected to the first drawing step are then preferably subjected to a dry heat treatment. The maximum temperature in the dry heat treatment is preferably 160 to 200° C., more preferably 165 to 198° C., and even more preferably 175 to 195° C. The treating period in the dry heat treatment from 10 seconds to 200 seconds provides preferable results. When the maximum temperature in the dry heat treatment falls below 160° C., the density of the obtained carbon fiber precursor fiber may be insufficient, resulting in difficulty in achieving the advantageous effects of the present invention in some cases. Alternatively, when the maximum temperature in the dry heat treatment exceeds 200° C., fusion between single fibers will be notable, and in the case of the production of a carbon fiber, the tensile strength of the obtained carbon fiber may be decreased. In the dry heat treatment, the draw ratio may be 1 or less in order to be adapted to contraction of the fibers. In addition, it is also preferable from the standpoint of process simplification to carry out drawing at the same time as the dry heat treatment (hereinafter, referred to as dry heat drawing). It is to be noted that the second drawing step carried out in a heating medium as described later and the dry heat drawing described now are treated as distinct steps in the present invention. The tension in the dry heat drawing is preferably 1.8 to 10 mN/dtex. The roller surface temperature in the dry heat drawing is preferably 140 to 200° C. The adjustment of the tension and temperature into the ranges mentioned above provides a precursor fiber according to the present invention without decreasing the $M_Z(F)/M_w(F)$. The draw ratio in the dry heat drawing is preferably 1.1 to 6 times, and more preferably 2 to 6 times. The draw ratio less than 1.1 times may result in an insufficient strength for the precursor fiber. On the other hand, the draw ratio greater than 6 times often decreases the $M_Z(F)/M_w(F)$.

For the purposes of improvement in productivity and improvement in the crystallite orientation degree, it is also possible to obtain a carbon fiber precursor fiber by subjecting the fibers to the second drawing step in a heating medium after the fibers is subjected to the dry heat treatment. As the heating medium applied in the case of carrying out the second drawing step, steam under pressure or over-heated steam is preferably used because the steam advantageous in terms of production stability and reduction in cost. In the case of applying the second drawing step, the tension during the second drawing step is preferably 1.8 to 6 mN/dtex, more preferably 3 to 6 mN/dtex, and even more preferably 4 to 5.8 mN/dtex. The tension increased to more than 6 mN/dtex in the second drawing step often causes cleavage of molecular chains to decrease the $M_Z(F)/M_w(F)$. In order to reduce the tension in the second drawing step to less than 1.8 mN/dtex, there is an approach of reducing the draw ratio or increasing the temperature (increasing the pressure in the case of using steam under pressure as the heating medium). However, the former impairs the productivity, whereas the latter is likely to cause drawing breakage due to fusing. In the case of using steam under pressure as the heating medium, the tension in the second drawing step can be controlled by the draw ratio and the pressure of the steam under pressure, but varies depending on the type of the PAN-based polymer, and it is this preferable to adjust the tension appropriately. The tension during the second drawing step can be obtained by using a tension meter to sandwich running fibers immediately after exiting a drawing zone such as a drawing tube and measure a load and by dividing the load by the fineness at the measurement point. The tension in the second drawing step is preferably 1.1 to 10 times, more preferably 1.1 to 6 times, and even more preferably 1.1 to 3 times. In the case of using steam under pressure as the heating medium to carry out the second drawing step, the steam pressure of the steam under pressure is preferably 0.1 to 0.7 MPa, more preferably 0.1 to 0.5 MPa, and even more preferably 0.2 to 0.4 MPa. It is to be noted that it is preferable that the second drawing step is not applied, because the $M_Z(F)/M_w(F)$ is more likely to be decreased as the number of drawing steps is increased. In the case of applying no second drawing step, it is preferable to carry out the dry heat drawing described above in order to improve the productivity.

As the draw ratio throughout the first drawing step, the dry heat drawing, and the second drawing step (hereinafter, referred to as a total draw ratio) is increased, the $M_Z(F)/M_w(F)$ is decreased in many cases. However, for the purpose of improving the dynamic properties of the carbon fiber obtained, it is preferable to increase the total draw ratio, and the total draw ratio is preferably 1 to 15 times, more preferably 2 to 13 times, and even more preferably 3 to 5 times in terms of the balance between the both.

The single fiber fineness of the thus obtained precursor fiber is preferably 0.1 to 1.2 dtex, more preferably 0.2 to 1.0 dtex, even more preferably 0.3 to 0.8 dtex. When the single fiber fineness of the precursor fiber is too small, the process stability in the process for producing precursor fibers and the oxidation-carbonization process may be decreased due to the occurrence of fiber breakage through contact with a roller or guide member. On the other hand, when the single fiber fineness is too large, the difference between the inner and outer structures for each single fiber after the oxidation step may be increased, thereby leading to decrease in processability in a subsequent carbonization, and to decrease in tensile strength and tensile modulus. It is to be noted that the single fiber fineness (dtex) in the present invention refers to weight (g) per 10,000 m of a single fiber.

In the present invention, the crystallite orientation degree for the obtained precursor fiber is preferably 85 to 90%, and more preferably 85 to 88%. The crystallite orientation degree less than 85% may decrease the tensile modulus of the carbon fiber obtained. On the other hand, the crystallite orientation degree more than 90% may fail to increase the draw ratio in the oxidation step, thereby generating fuzz. However, controlling the $M_Z(F)/M_w(F)$ of the precursor fiber allows fuzz to be prevented from generating in the oxidation step even with the comparable crystallite orientation degree, as compared with precursor fibers outside the present invention.

In addition, the Weibull shape parameter m(P) for the single fiber tensile strength of the precursor fiber according to the present invention is preferably 11 or more. The Weibull shape parameter indicates variations in single fiber tensile strength, and is preferably higher because fuzz can be prevented in the step for producing a carbon fiber. The Weibull shape parameter is preferably 13 or more, and has an industrial limit of up to 20. While there have been applications conventionally which specifies small variations in single fiber elongation of precursor fibers, it has been found that the profile of the single fiber strength distribution is important rather than the magnitude of the variation. None of precursor fibers obtained in accordance with conventional approaches shows a Weibull shape parameter of 11 or more. In addition, it has been found that the use of a precursor fiber with a high Weibull shape parameter shows a tendency to increase the Weibull shape parameter of fibers in the middle of an oxidation-carbonization process using the precursor fiber, and provides, as a final product, a carbon fiber with a high Weibull shape parameter. Therefore, the increased Weibull shape parameter of a precursor fiber provides a carbon fiber which has excellent processability in oxidation-carbonization process and has reduced variations in properties.

The single fiber tensile strength is obtained in accordance with JIS R7606 (2000), in the same way as in the case of carbon fibers. First, a bundle of precursor fibers 20 cm in length is divided into four bundles so that the number of single fibers for each bundle accounts for 25±5% with respect to the bundle of precursor fibers, and 100 single fibers are sampled randomly from each of the four divided bundles. The sampled single fibers are secured on a perforated board with the use of an adhesive. The board with the single fibers secured is attached to a tensile tester, and a tensile test is carried out under the conditions of a sample length of 25 mm and a tensile speed of 5 mm/min. The cross-sectional area of the fiber is calculated as an average cross-sectional area from the fineness and density measured in accordance with a method described below. The thus obtained single fiber tensile strength is used to obtain a Weibull plot from a double logarithm for the In strength and a function 1/(1−F) of fracture probability F, and the Weibull shape parameter is calculated from the slope of the plot.

The obtained carbon fiber precursor fiber is typically in the shape of continuous fiber (filament). In addition, the number of filaments (single fibers) constituting one fiber bundle is preferably 1,000 to 3,000,000, more preferably 12,000 to 3,000,000, even more preferably 24,000 to 2,500,000, and most preferably 24,000 to 2,000,000. Since the carbon fiber precursor fiber obtained according the present invention has high drawability, the single fiber fineness can be reduced. Therefore, the number of single fibers per one fiber bundle is increased in some cases in order to obtain one fiber bundle with desired total fineness. However, while a larger number of single fibers per one fiber bundle is preferable for the purpose of improvement of productivity, if it is too large, it is not possible in some cases to apply a uniform oxidation treatment up to the inside of the bundle. The single fiber tensile strength and the number of single fibers are appropriated adjusted depending on the purpose.

Next, a process for producing a carbon fiber according to the present invention will be described.

The process for producing a carbon fiber according to the present invention is provided to produce a carbon fiber by sequentially applying an oxidation step in which the carbon fiber precursor fiber as described above is subjected to oxidation treatment while carrying out drawing the carbon fiber precursor fiber at a draw ratio of 0.8 to 3.0 in the air at a temperature of 200 to 300° C., a preliminary carbonization step in which the fiber obtained in the oxidation step is subjected to preliminary carbonization while carrying out drawing preferably at a draw ratio of 1 to 1.3 in an inert atmosphere at a temperature of 300 to 800° C., and a carbonization step in which the fiber obtained in the preliminary carbonization step is subjected to carbonization while carrying out drawing preferably at a draw ratio of 0.96 to 1.05 in an inert atmosphere at a temperature of 1,000 to 3,000° C.

In the process for producing a carbon fiber according to the present invention, the imparting flame resistance refers to a step in which a heat treatment in an atmosphere containing 4 to 25 mol % or more of oxygen at 200 to 300° C. partially reduces or oxidizes the carbon fiber precursor fiber to increase the heat resistance. While the process for producing precursor fibers and the process from the oxidation step are typically not continuous, the process for producing precursor fibers and some or all of the oxidation step may be carried out continuously.

The draw ratio in imparting the flame resistance is 0.8 to 3, preferably 1.3 to 3, more preferably 1.4 to 2. When the draw ratio in imparting the flame resistance falls below 0.8, the partial cyclization structure of the PAN-based polymer in the oxidized fiber shows an insufficient degree of orientation, and the tensile modulus of the finally obtained carbon fiber is decreased. Alternatively, when the draw ratio in imparting the flame resistance exceeds 3, the production stability is decreased due to the generation of fuzz or fiber breakage. The use of the precursor fiber according to the present invention can significantly improve the draw ratio in the oxidation step, thus improving the productivity. In addition, the drawing tension in the oxidation step is preferably 0.1 to 0.25 g/dtex. When the drawing tension in the oxidation step is less than 0.1 g/dtex, it is difficult to improve the degree of orientation for the partial cyclization structure of the PAN-based polymer in the oxidized fiber. When the drawing tension is greater than 0.25 g/dtex, fuzz is likely to be generated in the oxidation step. The precursor fiber according to the present invention has a structure which is capable of increasing the draw ratio without increasing the drawing tension in the oxidation step, and is thus suitable for improvement in productivity.

The crystallite orientation degree of the partial cyclization structure of the PAN-based polymer in the oxidized fiber according to the present invention is preferably 78 to 85%, and more preferably 80 to 85%. These degrees are achieved by setting the conditions of the draw ratio and/or tension described above. More specifically, the crystallite orientation degree can be increased by increasing the draw ratio and/or tension. When the crystallite orientation degree falls below 78%, the tensile modulus of the obtained carbon fiber may be decreased. On the other hand, when the crystallite orientation degree exceeds 85%, setting a high draw ratio in the oxidation step may generate fuzz, thereby decreasing the productivity.

While the treating period of the oxidation can be appropriately selected within the range of 10 to 100 minutes, for the purpose of improvement in production stability in the subsequent preliminary carbonization step and improvement in dynamic properties of the carbon fiber, it is preferable to set the treating period so that the specific gravity of the obtained oxidized fiber fall within the range of 1.3 to 1.38.

In the oxidation step, any of a non-contact type such as an electric heater, a tenter in which the precursor fiber is pressed through the air heated with steam or the like, and an infrared heating unit and a contact type such as a plate-type heater and a drum-type heater is used as the means for heating the fibers. In order to improve the heat transfer efficiency, the heating is preferably carried out at least partially by a contact-type heating method, and more preferably carried out entirely by a contact-type heating method. The preliminary carbonization and the carbonization are carried out in an inert atmosphere, and as the inert gas used, for example, nitrogen, argon, and xenon, etc., are used. From an economical point of view, nitrogen is preferably used.

In addition, a carbon fiber according to the present invention will be described.

The carbon fiber according to the present invention is a carbon fiber of which the crystallite size (Lc (nm)) and parameters ($I_D/I_G$, $I_V/I_G$, $\nu_G$ ($cm^{-1}$)) concerning the carbon fiber surface, measured by Raman spectroscopy satisfy the following formulas (1) to (4).

$$1.5 \leq Lc \leq 2.6 \quad (1)$$

$$0.5 \leq I_D/I_G \leq 1 \quad (2)$$

$$0.4 \leq I_V/I_G \leq 0.8 \quad (3)$$

$$1{,}605 \leq \nu_G + 17(I_V/I_G) \leq 1{,}610 \quad (4)$$

First, various properties for use in the present invention will be described.

The carbon fiber is a polycrystal composed of numerous graphite crystallites. When the maximum temperature (hereinafter, abbreviated as a carbonization temperature) of the carbonization treatment is increased for the production of the carbon fiber, the rearrangement of the hexagonal carbon layer in the carbon fiber is caused, thereby promoting an increase in crystallite size and the crystallite orientation degree. Thus, the tensile modulus of the carbon fiber is increased. More specifically, there is a relationship in which under the other conditions kept constant, the increased carbonization temperature increases both of the crystallite size Lc and tensile modulus YM.

Next, the parameters measured by Raman spectroscopy will be described. Raman spectroscopy is a measurement method which is highly sensitive to lattice defects of carbon materials. The spectrum measured by Raman spectroscopy is divided into three types of peaks around 1,360 $cm^{-1}$, around 1,480 $cm^{-1}$, and around 1,600 $cm^{-1}$ by curve fitting using a quadratic function. The three types of peaks refers to as D band (around 1,360 $cm^{-1}$), a valley between D band and G band (around 1,480 $cm^{-1}$: the valley is also referred to as a peak in the present invention), and G band (around 1,600 $cm^{-1}$), respectively, which have peak intensities referred to as symbols $I_D$, $I_V$, and $I_G$, respectively. The D band reflects disordered carbon, the peak around 1,480 $cm^{-1}$ also reflects disordered carbon, and the G band reflects a vibrational mode itself of graphite. In the case of carrying out a study on the basis of the information, the peak intensity ratios are often obtained typically for carrying out the study. The ratios $I_D/I_G$ and $I_V/I_G$ are highly correlated with the crystallite size (Lc), in such a way that with increase in crystallite size, the $I_G$ is increased whereas the $I_V$, and $I_G$ are decreased. Furthermore, the meanings of the parameters will be described in detail. The $I_D/I_G$ tends to be monotonically decreased with respect to an increase in carbonization temperature, in such a way that the $I_D/I_G$ is on the order of 2 in the case of oxidization fiber in which almost no graphite is observed, decreased to around 1 from at carbonization temperatures from 500° C. to 900° C., and then slightly insensitive to the carbonization temperature. In addition, while the $I_V/I_G$ shows complex behavior with respect to an increase in the carbonization temperature, the $I_V/I_G$ shows a tendency to decrease from 0.8 to 0.4 at the carbonization temperature from around 1,200° C. to around 1,700° C. More specifically, the formulas (1) to (3) indicates that the carbonization treatment is carried out at the carbonization temperature on the order of 1,200 to 1,700° C. The Lc is increased by on the order of 1.5 nm when the carbonization treatment is increased by 100° C. Next, the peak wave number $\nu_G$ ($cm^{-1}$) of the G band will be described. It is believed that the peak wave number of the G band is highly correlated with π-electron conjugated structures associated with a crystallite size in the A-axis, the peak wave number tends to increase as the carbonization temperature is higher in the region at the carbonization temperature of 1,200 to 1,700° C. The $\nu_G$ is increased by on the order of 3 $cm^{-1}$ when the carbonization treatment is increased by 100° C. More specifically, in the case of conventional carbon fibers, as the carbonization temperature is increased from 1,200° C., the $I_V/I_G$ is decreased whereas the $\nu_G$ is increased, and in the case of a carbon fiber according to the present invention, the study for the present invention has revealed that when the $I_V/I_G$ has the same value as a phenomenon, the grade of the carbon fiber is improved as the $\nu_G$ is higher. It is believed on the basis of the above understanding that the $I_V/I_G$ with the same value and the higher $\nu_G$ mean that the π-electron conjugated structures have been developed in spite of the comparable crystallite size. On the other hand, since it is believed that the improvement in the grade of the carbon fiber corresponds to reduction of lattice defects in the carbon fiber, it is estimated that the carbon fiber according to the present invention has a higher $\nu_G$ with respect to the value of the $I_V/I_G$, as compared with conventional carbon fibers, and the grade of the carbon fiber has been improved because of having this property (the π-electron conjugated structures are developed for the crystallite size). As described above, the value of the $I_V/I_G$ shows a tendency to decrease with respect to an increase in carbonization temperature, whereas the $\nu_G$ has a tendency to increase with an increase in carbonization temperature. Thus, the $I_V/I_G$ and $\nu_G$ have an inverse correlation. Then, it is believed that the value as an index indicating the relationship between the crystallite size of the carbon fiber and the π-electron conjugated structures is obtained by multiplying either $I_V/I_G$ or $\nu_G$ by an appropriate coefficient to figure out a sum. It is the formula (4) that expresses the structure feature of the carbon fiber according to the present invention as an experimental formula. The expression for conventional fibers in the form of the formula (4) is $1{,}600 \leq \nu_G + 17(I_V/I_G) \leq 1{,}604$. More specifically, the carbon fiber according to the present invention is produced at the carbonization temperature represented by the formulas (1) to (3), and has a structure which satisfies the relationship of the formula (4). In the case of the parameter lower than 1,605, the grade of the obtained carbon fiber is only comparable to the grades of conventional fibers, whereas the parameter may exceed 1,610, but industrially has the upper limit. More specifically, the parameter is 1,607 or more. The use of the precursor fiber obtained in accordance with the present invention allows the parameter to be controlled within the range, thereby allowing the grade of the carbon fiber to be improved.

Next, the Weibull shape parameter m of the single fiber tensile strength of the carbon fiber will be described. The m refers to a feature as an index indicating the sensitivity to defects, and a higher value for m means that the carbon fiber is more insensitive. Metal materials have a Weibull shape parameter m around 20, stress concentration is more likely to occur at defect ends in the case of higher modulus materials, and conventional carbon fiber bundles have a Weibull shape parameter m of around 5. Among carbon fibers, carbon fibers with a low pitch modulus of around 41 GPa have a Weibull shape parameter m of around 7.9, whereas carbon fibers with a high pitch modulus of around 940 GPa have a Weibull shape parameter m of around 4.2. Thus, the higher modulus results in smaller m. In addition, the Weibull shape parameter m is also a feature indicating a defect size and the number density thereof, and is increased as the defect size and the number density thereof are more uniform. For example, even in the case of carbon fibers containing a lot of defects and constantly fracturing at a level of low strength in the length direction of the carbon fibers and even regardless of which single fiber is picked up, the m is increased. The tensile strength of the carbon fiber is greatly affected by the value of fracture toughness, defect sizes, and defect sizes. Since high intensity carbon fibers include a small amount of small defects, the defect size and shape between single fibers are less likely to be uniform. Therefore, the m tends to increase relatively. It is to be noted that the carbon fiber according to the present invention is typically formed as a fiber bundle, and as will be described later, single fibers are sampled to carry out a single fiber tensile test.

The carbon fiber according to the present invention satisfies the following formula when the Lc falls within the range of 1.8 to 2.6.

$$50Lc+210 \leq YM \leq 50Lc+270 \quad (5)$$

Conventionally used carbon fibers generally have a relationship of 50Lc+150≤YM<50Lc+210 in the Lc range of 1.8 to 2.6. In order to promote orientation of the crystals with the use of conventional fiber precursor fibers to such an extent that carbon fibers which meet 50Lc+210≤YM<50Lc+270 are obtained in the Lc range of 1.8 to 2.6, the heat treatment in the oxidation-carbonization process needs to be carried out under a high tension. However, the heat treatment carried out under such high tension causes fuzz, resulting in the need to frequently remove fuzz wound around the roller. In addition, the defect sizes and the distribution of the defect number density are increased, whereas the m is decreased. In contrast, the carbon fiber precursor fiber obtained in accordance with the present invention has a long series of molecular chains and is homogeneous, thus allowing a preliminary carbonized homogeneous fiber to be obtained for a carbonization treatment carried out under higher tensions, and thus allowing a carbon fiber according to the present invention to be produced.

The carbon fiber according to the present invention has the m measured by a method as will be described below, which is 6 or more, preferably 6.1 or more, and more preferably 7 or more. In the case of m less than 6, fuzz is increased for use as a composite material. While the m is preferably higher, is difficult to render the m 10 or more. In order to increase the m, it is important to use a homogeneous precursor fiber which varies little between single fibers. Furthermore, in order not to decrease the Weibull shape parameter m of the fiber undergoing each step of the oxidation-carbonization process for the production of a carbon fiber, it is important to set a draw ratio which has an enough margin with respect to the limited draw ratio to such an extent that no fuzz is generated in each step of oxidation-carbonization. When a lower draw ratio is set in order not to decrease the Weibull shape parameter m, the required YM is not required in some cases, and it is thus necessary to make a longer series of molecular chains for the precursor fiber so that a higher draw ratio can be set until fracture in the oxidation-carbonization process.

The single fiber tensile strength is obtained in accordance with JIS R7606 (2000) as follows. First, a bundle of carbon fibers 20 cm in length is divided into four bundles so that the number of single fibers for each bundle accounts for 25±5% with respect to the bundle of precursor fibers, and 100 single fibers are sampled randomly from each of the four divided bundles. The sampled single fibers are secured on a perforated board with the use of an adhesive. The board with the single fibers secured is attached to a tensile tester, the paper on the side surface is cut, and a tensile test is carried out at a sample length of 25 mm and a tensile speed of 1 mm/min. In all of the steps such as the sampling, the securement onto the board, and the attachment to the tester, the single fibers may be fractured before the tensile tester. Thus, in order to avoid selective removal of weak fibers, the batch is subjected to the tensile test again if fracture occurs. The cross-sectional area of the fiber is calculated as an average cross-sectional area from the fineness and density measured in accordance with a method described below. The thus obtained single fiber tensile strength is used to obtain a Weibull plot from a double logarithm of a logarithm for the strength and a function 1/(1−F) of fracture probability F, and the Weibull shape parameter is calculated from the slope of the plot.

The second Weibull shape parameter m" in the present invention is defined as a Weibull shape parameter obtained by straight-line approximation in the range of 0.3 to 1 for the fracture probability F. The second Weibull shape parameter m" is preferably 5.7 or more. While the above-described m is obtained from a Weibull plot by straight-line approximation, the Weibull plot for carbon fibers is found to be often curved. The material at the lower intensity side than the folding point contains a lot of defects, and often has a larger Weibull shape parameter, whereas the material at the higher intensity side than the folding point often has a smaller Weibull shape parameter. While the observation of fracturing as a composite material finds that single fiber fracture causes stress concentration in the vicinity of the fracture to easily induce fracture of neighboring single fibers, fracture of one single fiber does not lead to fracture of the entire composite material, and the composite material is often fractured when single fiber fracture occurs in single fibers of about 10 to 30% of the total number of single fibers. Therefore, the Weibull shape parameter for the lower intensity side than the folding point may be less likely to have an influence on the strength of the composite material, and the Weibull shape parameter for the higher intensity side than the folding point is thus often important. While the folding point varies with the fracture probability F of about 0.1 to 0.6, the Weibull shape parameter obtained in the range of 0.3 to 1 for the fracture probability F is not much different in the value of the Weibull shape parameter, thus preventing any wrong technical meaning. The m" can be controlled in the same way as the m, and the m" can be increased by increasing the Weibull shape parameter for the lower intensity side than the folding point, that is, adapting the Weibull shape parameter so as to provide defects with their sizes uniform and large. The m" of 5.7 or more is achieved by the use of a homogeneous precursor fiber with causes for defects reduced as much as possible and with a long series of molecular chains. The m" less than 5.7 may result in an increase in coefficient of variation (CV value) of tensile strength in the obtained CFRP.

In the present invention, the square of the correlation coefficient of a Weibull plot subjected to straight-line approximation is defined as $R^2$ in the signal fiber tensile test. The $R^2$ in the present invention is preferably 0.98 to 1, and more preferably 0.99 to 1. In the plot with 1−F (F: fracture probability) for the x axis and S (the product of load stresses) for the y axis, the maximum value of S is highly correlated with the tensile strength of unidirectional CFRP. While the plot for S ideally has upward convex inflection points forming one curve, a curve with multiple inflection points is formed in the case of a high degree of flexion, the minimum value of S is thus small for the average single fiber tensile strength, often resulting in the inability to bring out the dynamic properties effectively. It is assumed for the S that the other fibers bear an equal share of the stress for a fractured single fiber, and stress concentration occurs around the fractured single fiber. Thus, the S fails to directly indicate the properties of the composite material. However, the S is effective as one index indirectly indicating the properties of the composite material. The $R^2$ indicates the degree of flexion of a Weibull plot, and the Weibull plot shows a higher degree of flexion with a decrease in correlation coefficient. In the case of $R^2$ less than 0.98, there is a tendency to need to improve the average value for the dynamic properties of the carbon fiber, in order to satisfy the dynamic properties of the unidirectional composite material. The square $R^2$ of the correlation coefficient can be brought closer to 1 by reducing large defects other than defects distributed in the carbon fiber. The large defects are formed by fusion during the production of the precursor fiber, contaminants contained in the solution of the raw material polymer, staining during the process etc., and it is preferable to reduce the defects. It is to be noted that micro defects and macro defects determined from the sizes of the starting points of fractures in a fracture cross section in the tensile test through observation of the starting points under an electron microscope are not able to classified into of the higher intensity and lower intensity for the single fiber tensile strength, and thus less likely to be related to the square $R^2$ of the correlation coefficient.

In addition, the carbon fiber according to the present invention has a tensile modulus of carbon fibers as a resin impregnated strand TS of 6 to 9 GPa. Conventional carbon fibers have a crystallite size and a tensile modulus which satisfy the formula (5), and in the case of m of 6 or more, the TS is less than 6 GPa. Even when the carbon fiber is used for the purposes of the tensile strength and impact resistance strength, no striking effect has been achieved in reduction in weight of a structural material. In order to satisfy current demands in this field, the TS is preferably 6 GPa or more, more preferably 6.5 GPa or more, and even more preferably 7 GPa or more.

The carbon fiber according to the present invention has a crystallite size Lc of 1.5 to 2.6 nm. When the Lc of the carbon fiber is less than 1.5, the tensile strength is low; when the Lc is less than 1.8 nm, the crystallinity is low and the YM is low; and when the Lc is greater than 2.6 nm, the compressive strength is low. In each case, the balance between the tensile modulus and the compressive strength may be poor as a structural member. In order to improve the balance, the Lc is preferably 1.8 to 2.6 nm, and more preferably 2 to 2.4 nm. The Lc of the carbon fiber can be controlled by the carbonization temperature, and the increased carbonization temperature increases the Lc.

The carbon fiber according to the present invention preferably has an average single fiber diameter of 2 to 7 μm, and more preferably 5 to 7 μm. As the average single fiber diameter is smaller, the potential of the average tensile strength is higher. However, the average single fiber diameter less than 5 μm leads to an increase in the surface area with respect to the volume, and defects are thus likely to occur in the process after the fiber formation, which may easily degrade the Weibull shape parameter. Alternatively, when the average single fiber diameter is greater than 7 μm, the oxidation treatment is insufficient within the single fibers, and the YM may be thus less likely to be improved.

In addition, in the carbon fiber according to the present invention, the number of single fibers constituting a fiber bundle is preferably 12,000 to 48,000, and more preferably 24,000 to 48,000. While the smaller number of single fibers has the effect of facilitating uniform high-order processing treatments such as ion implantation and plasma processing, the case of use as a large-size structural material may result in an increase in the number of fibers used and a decrease in production efficiency. As long as the number of single fibers is 12,000 or more, a sufficient production efficient is obtained in many cases. Alternatively, the number of single fibers greater than 48,000 may lead to an inhomogeneous treatment in the oxidation-carbonization process, resulting in a decrease in m.

Furthermore, a process for producing a carbon fiber according to the present invention will be described. The carbon fiber can be produced by producing an oxidized fiber and further oxidizing and carbonizing the oxidized fiber in accordance with a method as described below.

The temperature of the preliminary carbonization is preferably 300 to 800° C. Further, it is preferable to set the rate of temperature increase in the preliminary carbonization at 500° C./minute or less.

The draw ratio for carrying out the preliminary carbonization is 1 to 1.3, preferably 1.1 to 1.3, and more preferably 1.1 to 1.2. When the draw ratio for carrying out the preliminary carbonization falls below 1, the degree of orientation for the preliminarily carbonized fibers obtained is insufficient, and the tensile modulus of carbon fibers as a resin impregnated strand for the carbon fibers is decreased. Alternatively, when the draw ratio for carrying out the preliminary carbonization exceeds 1.3, the generation of fuzz or the generation of fiber breakage decreases the processability.

The carbonization temperature is 1,000 to 2,000° C., preferably 1,200 to 1,800° C., and more preferably 1,300 to 1,600° C. While the increased carbonization temperature increases the tensile modulus of carbon fibers as a resin impregnated strand, the tensile strength reaches a maximum at around 1,500° C. Thus, the carbonization temperature is set in view of the balance between the both.

The draw ratio for carrying out the carbonization is 0.96 to 1.05, preferably 0.97 to 1.05, and more preferably 0.98 to 1.03. When the draw ratio for carrying out the carbonization falls below 0.96, the degree of orientation and density of the carbon fiber obtained are insufficient, resulting in a decrease in tensile modulus of carbon fibers as a resin impregnated strand. Alternatively, when the draw ratio for carrying out the carbonization exceeds 1.05, the generation of fuzz or the occurrence of fiber breakage decreases the processability.

The obtained carbon fiber can be subjected to an electrolytic treatment for its surface modification. As an electrolyte for use in the electrolytic treatment, an acidic solution such as sulfuric acid, nitric acid and hydrochloric acid, and an alkali such as sodium hydroxide, potassium hydroxide, tetraethyl ammonium hydroxide, ammonium carbonate and ammonium bicarbonate or salts thereof as an aqueous solution can be used. Herein, the amount of electric required for the electrolytic treatment can be appropriately selected depending on a degree of carbonization of the carbon fiber to be applied.

The electrolytic treatment makes it possible to make the adhesion properties appropriate between the carbon fiber and a matrix therefore in a fiber reinforced composite material to be obtained. Specifically, the following problems are solved; the problem of a brittle breakage of the composite material caused by too strong adhesion, the problem of a decrease in tensile strength in the fiber direction, or the problem of, in spite of the high tensile strength in the fiber direction, inferior adhesion properties with resin resulting no development of the strength properties in the non-fiber direction. The fiber reinforced composite material to be obtained by the electrolytic treatment is adapted to develop strength properties with good balance between both of the fiber direction and the non-fiber direction.

After the electrolytic treatment, a sizing treatment can also be carried out in order to impart a unity of bundle to the carbon fiber. As the sizing agent, it is possible to appropriately select a sizing agent which is compatible with a matrix resin, etc., depending on the type of the resin to be used.

The carbon fiber obtained according to the present invention can be subjected to a variety of molding methods, for example, to autoclave molding as a prepreg, to resin transfer molding as a preform such as woven fabrics, and to molding by filament winding. These molded articles are preferably used as aircraft members, pressure container members, automobile members or sporting members such as fishing rods or golf shafts.

EXAMPLES

The present invention will be further specifically described below with reference to examples. Methods for measuring various properties used in the examples will be then described.

<Various Types of Molecular Weight: $M_{Z+1}$, $M_Z$, $M_w$, Mn>

A polymer to be measured is dissolved in dimethyl formamide (0.01 N-lithium bromide is added) such that the concentration is 0.1 wt %, to obtain a solution to be tested. In the case of a measurement for a precursor fiber, the precursor fiber is dissolved in a solvent to obtain the solution to be tested. However, the precursor fiber is less likely to be dissolved as the precursor fiber is highly oriented and dense, and as the dissolution time is long and as the dissolution temperature is higher, the precursor fiber tends to be measured to have a lower molecular weight. Thus, the precursor fiber was subjected to fine grinding and dissolved for one day in a solvent controlled to 40° C. while stirring with the use of a stirrer. For the obtained solution to be tested, a molecular weight distribution curve was obtained from a GPC curve measured under the following conditions by using a GPC device, and $M_{Z+1}$, $M_Z$, $M_w$, and Mn were calculated.

Column: Polar Organic Solvent Type column for GPC
Flow Rate: 0.5 ml/min
Temperature: 75° C.
Filtration of Sample: Membrane Filter (0.45 μm cut)
Amount of Injection: 200 μl
Detector: Differential Refractometer A calibration curve of elusion time-molecular weight was created by using at least 6 types of single-distribution polystyrene different in molecular weight of which molecular weights are known, and a molecular weight in terms of polystyrene was read which corresponds to the elusion time on the calibration curve, thereby obtaining the M.

In the examples, CLASS-LC2010 produced by Shimadzu Corp., as the GPC device, TSK-GEL-α-M(×2) produced by Tosoh Corp., +TSK-guard Column α produced by Tosoh Corp., as the column, dimethyl formamide and lithium bromide produced by Wako Pure Chemical Industries, Ltd., 0.45 μm-FHLP FILTER produced by Millipore Corp., as the membrane filter, RID-10AV produced by Shimadzu Corp., as the differential refractometer and polystyrenes of molecular weight 184,000, 427,000, 791,000, 1,300,000 1,810,000, and 4,210,000 as the single-distribution polystyrenes for preparing the calibration curve, were used, respectively.

<Viscosity of Spinning Solution>

As a B-type viscometer, B8L-type viscometer produced by Tokyo Keiki Inc., was used to measure the viscosity of the spinning solution at a temperature of 45° C. in each case, in such a way that the viscosity of the spinning solution in the range of 0 to 100 Pa·s is measured at a rotation speed of 6 r.p.m. for No. 4 rotor, and the viscosity in the range of 100 to 1,000 Pa·s is measured at a rotation speed of 0.6 r.p.m.

<The Crystallite Orientation Degree of Precursor Fiber and Oxidized Fiber>

The crystallite orientation degree in the fiber axis direction was measured as follows. A fiber bundle was cut into a length of 40 mm, 20 mg of the fiber bundle was precisely weighed and sampled, and aligned so the sample fiber was accurately parallel, and then, a jig for a sample adjustment was used to prepare a sample fiber bundle with a width of 1 mm and a uniform thickness. The sample fiber bundle was impregnated with a dilute collodion solution to fix the fiber bundle so as not to break the form thereof, and then fixed on a stage for wide angle X ray diffraction measurement. With the use of Cu-Kα ray rendered monochromatic through a Ni-filter as a X-ray source, the crystallite orientation degree (%) was obtained with the use of the following formula, from the half width (H°) of a profile extended in the meridional direction including the maximum diffraction intensity observed in the vicinity of 2θ=17°.

$$\text{The Crystallite Orientation Degree (\%)}=[(180-H)/180]\times 100$$

It is to be noted that XRD-6100 produced by Shimadzu Corp., was used as the above-mentioned wide angle X ray diffractometer.

<Single Fiber Fineness of Precursor Fiber>

A roll of fiber composed of 6,000 single fibers was wound 10 times around a metal frame with a circumference of 1 m, and the weight of the wound fiber was then measured to calculate the weight per 10,000 m, thereby obtaining the single fiber fineness.

<Limited Oxidation Draw Ratio>

The obtained precursor fiber was introduced hot air circulation equipment with an atmosphere temperature kept at 240° C. and a length of 7.5 m. Rollers for feeding or winding the precursor fiber were arranged at the front and back of the equipment, and the draw ratio was measured by changing the feeding roller speed while keeping the speed of the winding roller at 2.5 m/min. The speed of the roller was changed by 0.1 in terms of draw ratio, and the number of fuzz formations for 3 minutes from 9 minutes after the change of the speed was counted at each speed. Any of 10 fuzz formations/m or more, 10 or more fibers partially broken, and the entire fiber bundle broken was considered as over the limited oxidation draw ratio, and the ratio obtained by subtracting 0.1 from the draw ratio at the fuzz or fiber breakage was defined as the limited oxidation draw ratio.

<The Tensile Strength and Modulus Carbon Fibers as a Resin Impregnated Strand>

The tensile strength and modulus of carbon fiber bundle are determined in accordance with JIS R7608 (2007) "Test Method of Resin Impregnated Strand of Carbon Fiber". The resin impregnated strand of carbon fiber to be measured was prepared by impregnating carbon fiber or graphitized fiber with 3,4-epoxycyclohexyl methyl-3,4-epoxycyclohexyl carboxylate (100 parts by weight)/boron trifluoride monoethyl amine (3 parts by weight)/acetone (4 parts by weight), and by curing at a temperature of 130° C. for 30 minutes. In addition, the number of carbon fibers as a resin impregnated strands to be measured is 6, and the average value of respective measurement results is taken as the tensile strength. In the examples, as the 3,4-epoxycyclohexyl methyl-3,4-epoxycyclohexyl carboxylate, "BAKELITE" (Registered Trademark) ERL4221 produced by Union Carbide Corp., was used.

<Weibull Shape Parameter m, m" and Square of Correlation Coefficient $R^2$ of Single Fiber Tensile Strength of Carbon Fiber>

The single fiber strength of the carbon fiber was obtained in accordance with JIS R7606 (2000) as follows. First, a bundle of precursor fibers which was 20 cm in length was divided into four bundles so that the number of single fibers for each bundle accounts for 25±5% with respect to the bundle of precursor fibers, and 100 single fibers were sampled randomly from each of the four divided bundles. The sampled single fibers were secured on a perforated board with the use of an adhesive. The board with the single fibers secured was attached to a tensile tester, and a tensile test was carried out under the conditions of a sample length of 25 mm and a tensile speed of 5 mm/min. The Weibull shape parameter was obtained in accordance with the definition of the following formula.

$$\ln\ln\{1/(1-F)\}=m\ln\sigma+C$$

The symbol F indicates a fracture probability, which was obtained by a cumulative distribution method for a target sample. The symbols σ, m, and C indicates a single fiber tensile strength (MPa), a Weibull shape parameter, and a constant number, respectively. A Weibull plot was obtained lnln {1/(1−F)} and ln σ, and subjected to first order approximation to obtain m from the slope. The correlation function at the m obtained from the slope is referred to as R. The In addition, lnln {1/(1−F)} and ln σ were subjected to first order approximation in the range of 0.3 to 1 for F to obtain m" from the slope.

The cross section of the single fiber was obtained in accordance with JIS R7607 (2000) by, for a fiber bundle to be measured, dividing the weight (g/m) per unit length by the density (g/m$^3$) and further by the number of single fibers.

<Weibull Shape Parameter m(P) of Single Fiber Tensile Strength of Precursor Fiber>

The Weibull shape parameter m(P) was obtained in the same way as in the carbon fiber, except that the tensile speed was set at 5 mm/min.

<Crystallite Size of Carbon Fiber>

The carbon fibers to be measured was aligned unidirectionally and fixed by using a collodion alcohol solution, to prepare a square prism measurement sample with a height of 4 cm and each side length of 1 mm. For the prepared measurement sample, a measurement was carried out by using a wide angle X-ray diffractometer under the following conditions.

X ray Source: Cu-Kα ray (Tube Voltage 40 kV, Tube Current 30 mA)

Detector: Goniometer+Monochrometer+Scintillation Counter

Scanning Range: 2θ=10° to 40°

Scanning Mode Step Scan, Step Interval 0.02°, Counting Time 2 seconds

In the obtained diffraction pattern, a half width of the peak appearing in the vicinity of 2θ=25° to 26° was obtained, and based on the value, the crystallite size was calculated from the following Scherrer's equation:

$$\text{Crystallite Size (nm)}=K\lambda/\beta_0\cos\theta_B$$

where,

K: 1.0, λ: 0.15418 nm (Wavelength of X ray)

$\beta_0$: $(\beta_E^2-\beta_1^2)^{1/2}$ $\beta_E$: Apparent Half Width (Measured Value) rad, $\beta_1$: 1.046×$10^{-2}$ rad $\theta_B$: Bragg Diffraction Angle It is to be noted that XRD-6100 produced by Shimadzu Corp., was used as the above-mentioned wide angle X ray diffractometer.

<Average Single Fiber Diameters of Precursor Fiber and Carbon Fiber>

For a precursor fiber bundle or a carbon fiber bundle to be measured, the weight Af (g/m) per unit length and specific gravity Bf(g/cm$^3$) are obtained. With the number of single fibers of the fiber bundle to be measured as Cf, the average single fiber diameter (μm) for the fibers was calculated from the following equation. The specific gravity was obtained by Archimedes' method in which o-dichlorobenzene was used for the measurement of the carbon fiber whereas ethanol was used for the measurement of the precursor fiber.

$$\text{Average Single Fiber Diameter of Carbon Fiber (μm)}=((Af/Bf/Cf)/\pi)^{(1/2)}\times2\times10^3$$

<Raman Spectroscopy for Carbon Fiber>

The measurement system and the measurement conditions were as follows.

Measurement System: Ramaonor T-64000 microprobe (microscopic mode) produced by JobinYvon Objective Lens: ×100

Beam Diameter: 1 μm

Type of Laser: $Ar^+$ (Excitation Wavelength: 514.5 nm)

Laser Power: 1 mW

Configuration: 640 mm Triple Monochromator

Diffraction Grafting: 600 gr/mm (Produced by Spectrograph)

Dispersion: Single, 21 A/mm

Slit: 100 μm

Detector CCD (Produced by JobinYvon, 1024×256)

In the measurement, laser light was collected onto the CF surface, and the plane of polarization was brought into line with the fiber axis. A different type of single fiber was used for each sample to make a measurement with n=6. The average for the measurements was used for spectrum comparison and analysis. The Raman Spectrum is obtained as a result of a baseline correction carried out by straight line approximation between 900 cm$^{-1}$ and 2,000 cm$^{-1}$. Each Raman band intensity was calculated in such a way that a local maximum point and a local minimum point were estimated by applying the least squares approximation using a quadratic function to 40 data points around 1,360 cm$^{-1}$, 1,480 cm$^{-1}$, and 1,600 cm$^{-1}$. The wavenumber axis was calibrated do that the light emission line of 546.1 nm as an emission line of a low-pressure mercury vapor lamp corresponds to 1,122.7 cm$^{-1}$.

Comparative Example 1

100 parts by weight of AN, 1 part by weight of itaconic acid, 4 parts by weight of AIBN as a radical initiator, and 0.1 parts by weight of octyl mercaptan as a chain transfer agent were homogeneously dissolved in 370 parts by weight of dimethyl sulfoxide, and put into a reactor equipped with a reflux tube and a stirring blade. After the space in the reactor was replaced with nitrogen up to an oxygen concentration of 1,000 ppm, and a heat treatment was carried out under the following condition (referred to as polymerization condition A), while stirring to carry out polymerization by a solution polymerization method, thereby obtaining a PAN-based polymer solution.

(1) Heating from 30° C. to 60° C. (heating speed 10° C./hour)

(2) Holding at a temperature of 60° C. for 4 hours (3) Heating from 60° C. to 80° C. (heating speed 10° C./hour)

(4) Holding at a temperature of 80° C. for 6 hours

After the obtained PAN-based polymer solution was prepared to have a polymer concentration of 20 wt %, an ammonia gas was blown until the pH was 8.5 to introduce an ammonium group into the polymer while neutralizing the itaconic acid, thereby obtaining a spinning solution. The PAN-based polymer in the obtained spinning solution had $M_w$ of 400,000, $M_Z/M_w$ of 1.8, and $M_{Z+1}/M_w$ of 3.0, and the viscosity of the spinning solution was 50 Pa·s. The obtained spinning solution was passed through a filter with a filtration accuracy of 10 μm, then extruded at a temperature of 40° C. once into the air with the use of a spinneret with the number of holes of 3,000 and a spinneret hole diameter 0.12 mm, and passed through the space of about 2 mm, and spinning was then carried out under the condition that the draft ratio at spinning was 4, by a dry-wet spinning method which involves introduction into a coagulation bath composed of a solution of 20 wt % of dimethyl sulfoxide controlled to a temperature of 3° C., thereby obtaining a swelling fibers. The obtained swelling fibers was washed with water, and subjected to a first drawing step in a bath at a tension of 2.2 mN/dtex. The bath temperature was 65° C., and the draw ratio was 2.7. An amino-modified silicone-based silicone oil agent was applied to the fibers subjected to the first drawing step, a roller heated to a temperature of 165° C. was used to carry out a dry heat treatment for 30 seconds, and a second drawing step was then carried out in steam under pressure at a tension of 5.3 mN/dtex to obtain a carbon fiber precursor fiber. In the second drawing step, the pressure of the steam under pressure was set at 0.4 MPa, and the draw ratio was set at 5.2. The Weibull shape parameter m(P) of the obtained precursor fiber was 10, the coefficient of variation (CV) of the single fiber strength was 12%, and the coefficient of variation (CV) of the single fiber elongation was 7%.

Comparative Example 2

A carbon fiber precursor fiber was obtained in the same way as in Example 1, except that the draft ratio at spinning was changed to 5, the second drawing step was changed from the steam to dry heat, and the second drawing ratio was changed to 3.0.

Example 1

100 parts by weight of AN, 1 part by weight of itaconic acid, and 130 parts by weight of dimethyl sulfoxide were mixed, and put into a reactor equipped with a reflux tube and a stirring blade. After the space in the reactor was replaced with nitrogen up to an oxygen concentration of 100 ppm, 0.002 parts by weight of 2,2'-azobisisobutylonitril (AIBN) was put as a radical initiator, and a heat treatment was carried out under the following condition (referred to as polymerization condition B), while stirring.

Holding at a temperature of 65° C. for 2 hours.

Cooling from 65° C. to 30° C. (Cooling Speed 120° C./hour)

Next, 240 parts by weight of dimethyl sulfoxide, 0.4 parts by weight of AIBN as the polymerization initiator and 0.1 parts by weight of octyl mercaptan as a chain transfer agent were weighed and introduced to the reactor, and furthermore, a heat treatment under the polymerization conditions A in Comparative Example 1 was carried out while stirring, to polymerize the remaining unreacted monomer by a solution polymerization method, thereby obtaining a PAN-based polymer solution.

After the obtained PAN-based polymer solution was used and prepared to have a polymer concentration of 20 wt %, an ammonia gas was blown until the pH was 8.5 to introduce an ammonium group into the PAN-based polymer while neutralizing the itaconic acid, thereby obtaining a spinning solution. The PAN-based polymer in the obtained spinning solution had $M_w$ of 480,000, $M_Z/M_w$ of 5.7, and $M_{Z+}/M_w$ of 14, and the viscosity of the spinning solution was 45 Pa·s. Spinning was carried out in the same way as in Comparative Example 1, except that the spinning solution was changed to the spinning solution obtained as described above. The obtained precursor fiber was superior in grade, and sampling was able to be stably carried out in the spinning step. While the $M_Z/M_w$ of the precursor fiber was decreased as compared with the $M_Z/M_w$ of the spinning solution, the higher value was still kept as compared with Comparative Example 1, resulting in an increase in limited oxidation draw ratio.

Example 2

Spinning was carried out in the same way as in Example 1, except that the draft ratio at spinning was changed to 12, the second drawing step was changed from the steam to dry heat, and the second drawing ratio was changed to 1.1. The obtained precursor fiber was superior in grade, and sampling was able to be stably carried out in the spinning step. The reduction in draft ratio at spinning kept the $M_Z/M_w$ of the precursor fiber slightly decreased as compared with the $M_Z/M_w$ of the spinning solution, resulting in a high limited oxidation draw ratio.

Example 3

Spinning was carried out in the same way as in Example 2, except that the draw ratio after drying was changed to 2.0. The obtained precursor fiber was superior in grade, and sampling was able to be stably carried out in the spinning step. While the $M_Z/M_w$ of the precursor fiber was decreased more than in Example 2, the high value was still kept, resulting in a high limited oxidation draw ratio.

Example 4

A spinning solution was obtained in the same way as in Example 1, except that the first input of AIBN was changed to 0.001 parts by weight, the space in the reactor was replaced with nitrogen up to an oxygen concentration of 1,000 ppm, and the polymerization conditions A were changed to the polymerization conditions C.

(1) Holding at a temperature of 70° C. for 4 hours (2) Cooling from 70° C. to 30° C. (Cooling Speed 120° C./hour)

The PAN-based polymer in the obtained spinning solution had $M_w$ of 340,000, $M_Z/M_w$ of 2.7, and $M_{Z+1}/M_w$ of 7.2, and the viscosity of the spinning solution was 40 Pa·s. Spinning was carried out in the same way as in Comparative Example 1, except that the spinning solution was changed to the spinning solution obtained as described above. The obtained precursor fiber was superior in grade, and sampling was able to be stably carried out in the spinning step. While the $M_Z/M_w$ of the precursor fiber was slightly decreased as compared with the $M_Z/M_w$ of the spinning solution, the higher value was still kept as compared with Comparative Example 1, resulting in an increase in limited oxidation draw ratio. The Weibull shape parameter m(P) of the obtained precursor fiber was 13, the coefficient of variation (CV) of the single fiber strength was 9%, and the coefficient of variation (CV) of the single fiber elongation was 7%.

Example 5

A spinning solution was obtained in the same way as in Example 4, except that the first input of AIBN was changed to 0.002 parts by weight, and the holding time was 1.5 hours in the polymerization conditions C. The PAN-based polymer in the obtained spinning solution had $M_w$ of 320,000, $M_Z/M_w$ of 3.4, and $M_{Z+1}/M_w$ of 12, and the viscosity of the spinning solution was 35 Pa·s. Spinning was carried out in the same way as in Comparative Example 1, except that the spinning solution was changed to the spinning solution obtained as described above. The obtained precursor fiber was superior in grade, and sampling was able to be stably carried out in the spinning step. While the $M_Z/M_w$ of the precursor fiber was slightly decreased as compared with the $M_Z/M_w$ of the spinning solution, the higher value was still kept as compared with Comparative Example 1, resulting in an increase in limited oxidation draw ratio.

Example 6

100 parts by weight of AN, 1 part by weight of itaconic acid, and 360 parts by weight of dimethyl sulfoxide were mixed, and put into a reactor equipped with a reflux tube and a stirring blade. After the space in the reactor was replaced with nitrogen up to an oxygen concentration of 100 ppm, 0.003 parts by weight of AIBN was put as the polymerization initiator, and a heat treatment was carried out under the following condition, while stirring.

(1) Holding at a temperature of 60° C. for 3.5 hours

Next, 10 parts by weight of dimethyl sulfoxide, 0.4 parts by weight of AIBN as the polymerization initiator and 0.1 parts by weight of octyl mercaptan as a chain transfer agent were weighed and introduced to the reactor, and furthermore, a heat treatment under the following conditions was carried out while stirring, to polymerize the remaining unreacted monomer by a solution polymerization method, thereby obtaining a PAN-based polymer solution.

(2) Holding at a temperature of 60° C. for 4 hours (3) Heating from 60° C. to 80° C. (heating speed 10° C./hour)

(4) Holding at a temperature of 80° C. for 6 hours

After the obtained PAN-based polymer solution was prepared to have a polymer concentration of 20 wt %, an ammonia gas was blown until the pH was 8.5 to introduce an ammonium group into the polymer while neutralizing the itaconic acid, thereby obtaining a spinning solution.

The PAN-based polymer in the obtained spinning solution had $M_w$ of 400,000, $M_Z/M_w$ of 5.2, and $M_{Z+}/M_w$ of 10, and the viscosity of the spinning solution was 55 Pa·s. Spinning was carried out in the same way as in Example 1, except that the spinning solution was changed to the spinning solution obtained as described above. The obtained precursor fiber was superior in grade, and sampling was able to be stably carried out in the spinning step. While the $M_Z/M_w$ of the precursor fiber was slightly decreased as compared with the $M_Z/M_w$ of the spinning solution, the higher value was still kept, resulting in an increase in limited oxidation draw ratio.

Comparative Example 3

100 parts by weight of AN, 1 part by weight of itaconic acid, and 0.2 parts by weight of AIBN as a radical initiator were homogeneously dissolved in 460 parts by weight of dimethyl sulfoxide, and put into a reactor equipped with a reflux tube and a stirring blade. After the space in the reactor was replaced with nitrogen up to an oxygen concentration of 1,000 ppm, and a heat treatment was carried out under the polymerization condition A described above, while stirring to carry out polymerization by a solution polymerization method, thereby obtaining a PAN-based polymer solution. After the obtained PAN-based polymer solution was prepared to have a polymer concentration of 15 wt %, an ammonia gas was blown until the pH was 8.5 to introduce an ammonium group into the polymer while neutralizing the itaconic acid, thereby obtaining a spinning solution. The PAN-based polymer in the obtained spinning solution had $M_w$ of 650,000, $M_Z/M_w$ of 1.8, and $M_{Z+1}/M_w$ of 3.0, and the viscosity of the spinning solution was 95 Pa·s. Spinning was carried out in the same way as in Comparative Example 1, except that the spinning solution was changed to the spinning solution obtained as described above. The $M_Z/M_w$ of the precursor fiber remained unchanged from the $M_Z/M_w$ of the spinning solution, resulting in a low limited oxidation draw ratio.

Comparative Example 4

Spinning was carried out in the same way as in Example 2, except that the spinning solution was changed to the spinning solution obtained in Comparative Example 3. The $M_Z/M_w$ of the precursor fiber was lower, and the limited oxidation draw ratio was thus lower than those in Examples 2 and 6.

The experimental conditions in the examples and comparative examples described above and the properties of the obtained precursor fibers are summarized in Table 1.

Example 8

100 parts by weight of AN, 1 part by weight of itaconic acid, and 230 parts by weight of dimethyl sulfoxide were mixed, and put into a reactor equipped with a reflux tube and a stirring blade. After the space in the reactor was replaced with nitrogen up to an oxygen concentration of 1,000 ppm, 0.002 parts by weight of AIBN as the polymerization initiator, and 0.01 parts by weight of octyl mercaptan as a chain transfer agent were put, and a heat treatment was carried out under the polymerization conditions, while stirring.

(1) Holding at a temperature of 65° C. for 1 hour (2) Cooling from 65° C. to 30° C. (Cooling Speed 120° C./hour)

Next, 10 parts by weight of dimethyl sulfoxide, 0.4 parts by weight of AIBN as the polymerization initiator and 0.3 parts by weight of octyl mercaptan as a chain transfer agent were weighed and introduced to the reactor, and furthermore, a heat treatment under the polymerization conditions A in Comparative Example 1 was carried out while stirring, to polymerize the remaining unreacted monomer by a solution polymerization method, thereby obtaining a PAN-based polymer solution.

After the obtained PAN-based polymer solution was prepared to have a polymer concentration of 27 wt %, an ammonia gas was blown until the pH was 8.5 to introduce an ammonium group into the polymer while neutralizing the itaconic acid, thereby obtaining a spinning solution. The PAN-based polymer in the obtained spinning solution had $M_w$ of 200,000, $M_Z/M_w$ of 3.3, and $M_{Z+}/M_w$ of 14, and the viscosity of the spinning solution was 95 Pa·s. Spinning was carried out in the same way as in Comparative Example 1, except that the spinning solution was changed to the spinning solution obtained as described above, the spinning temperature was set at 80° C., and the yarn making conditions were as shown in Table 1. The obtained precursor fiber was superior in grade, and had a high limited oxidation draw ratio.

Example 9

100 parts by weight of AN, 1 part by weight of itaconic acid, and 130 parts by weight of dimethyl sulfoxide were mixed, and put into a reactor equipped with a reflux tube and a stirring blade. After the space in the reactor was replaced with nitrogen up to an oxygen concentration of 100 ppm, 0.002 parts by weight of 2,2'-azobisisobutylonitrile (AIBN) as a radical initiator was put, and a heat treatment was carried out under the following conditions, while stirring.

(1) Holding at a temperature of 65° C. for 5 hours

Cooling from 65° C. to 30° C. (Cooling Speed 120° C./hour)

Next, 610 parts by weight of dimethyl sulfoxide, 0.2 parts by weight of AIBN as a radical initiator and 0.01 parts by weight of octyl mercaptan as a chain transfer agent were weighed and introduced to the reactor, and furthermore, a heat treatment under the polymerization conditions A in Comparative Example 1 was carried out while stirring, to polymerize the remaining unreacted monomer by a solution polymerization method, thereby obtaining a PAN-based polymer solution.

After the obtained PAN-based polymer solution was used and prepared to have a polymer concentration of 10 wt %, an ammonia gas was blown until the pH was 8.5 to introduce an ammonium group into the PAN-based polymer while neutralizing the itaconic acid, thereby obtaining a spinning solution. The PAN-based polymer in the obtained spinning solution had $M_w$ of 590,000, $M_Z/M_w$ of 5.2, and $M_{Z+}/M_w$ of 14, and the viscosity of the spinning solution was 10 Pa·s. Spinning was carried out in the same way as in Comparative Example 1, except that the spinning solution was changed to the spinning solution obtained as described above, the spinning temperature was set at 20° C., and the yarn making conditions were as shown in Table 1. The obtained precursor fiber was superior in grade, and had a high limited oxidation draw ratio.

Comparative Example 5

The same spinning solution as in Example 1 was used. The spinning solution was passed through a filter with a filtration accuracy of 0.5 μm, then extruded at a temperature of 40° C. once into the air with the use of a spinneret with the number of holes of 6,000 and a spinneret hole diameter 0.15 mm, and passed through the space of about 2 mm, and spinning was then carried out by a dry-wet spinning method which involves introduction into a coagulation bath composed of a solution of 20 wt % of dimethyl sulfoxide controlled to a temperature of 3° C., thereby obtaining a coagulated fibers. In addition, under the condition that the draft ratio at spinning was 4, the coagulated fibers was obtained and washed with water, then subjected to drawing at a draw ratio in a bath of 3 in warm water at 90° C., further, an amino-modified silicone-based silicone oil agent was applied, a roller heated to a temperature of 165° C. was used to carry out drying for 30 seconds, and drawing at a draw ratio of 5 was in steam under pressure carried out to obtain a precursor fiber. While the obtained precursor fiber was superior in grade, the limited oxidation draw ratio was comparative to that in the comparative examples.

The precursor fibers obtained as described above, which are shown in Table 2, with the number of single fibers constituting a fiber bundle kept at 6,000 were subjected to a oxidation treatment for 90 minutes while carrying out drawing at a draw ratio of 1.0 in the air with a temperature distribution of 240 to 260° C., thereby obtaining oxidized fibers. Subsequently, the obtained oxidized fibers were subjected to a preliminary carbonization treatment while carrying out drawing at a draw ratio of 1.2 in a nitrogen atmosphere with a temperature distribution of 300 to 700° C., and further subjected to a carbonization treatment with a draw ratio set at 0.97 in a nitrogen atmosphere at a maximum temperature of 1,500° C., thereby obtaining continuous carbon fibers. Since the draw ratio in the oxidation treatment had an enough margin, the passage through the oxidation-carbonization process was favorable at any time.

Examples 9 to 17

Comparative Examples 6 to 8

The precursor fibers obtained as described above, which are shown in Table 2 were formed into multiple wound yarns of 8 precursor fibers so as to keep the number of single fibers constituting a fiber bundle at 24,000, and subjected to a oxidation treatment for 90 minutes while carrying out drawing at draw ratios shown in Table 2 in the air with a temperature distribution of 240 to 260° C., thereby obtaining oxidized fibers. Subsequently, the obtained oxidized fibers were subjected to a preliminary carbonization treatment while carrying out drawing at a draw ratio of 1.2 in a nitrogen atmosphere with a temperature distribution of 300 to 700° C., thereby preliminary carbonized fiber bundles. The obtained preliminary carbonized fiber bundles were subjected to a carbonization treatment for the preliminary carbonized fiber bundles with a draw ratio of 0.96 in a nitrogen atmosphere with a maximum temperature of 1,500° C., thereby obtaining continuous carbon fibers. The examples had almost no fuzz observed in the oxidation step, preliminary carbonization step or carbonization step, and were favorable in both production stability and grade. The comparative examples had fuzz caused in the oxidation step, preliminary carbonization step and carbonization step, it can hardly be thus said that the comparative examples were favorable in both production stability and grade, and there were clear differences between the comparative examples and the examples. In particular, in Comparative Examples 6 and 7, little fuzz was caused even from at the low draw ratio in spite of the limited oxidation draw ratio, resulting in a poor grads. Table 2 shows the results of measuring the degree of orientation for the obtained and oxidized fibers and the strand properties for the carbon fiber bundles.

Examples 18 to 20

Comparative Examples 9 to 11

A carbon fiber bundle was obtained in the same way as in Example 17 or Comparative Example 6, except that the maximum temperature in the carbonization treatment was changed as shown in Table 3. The evaluation results for the obtained carbon fiber bundle are shown in Table 3.

TABLE 1

| | Spinning Solution | | | | | Spinning Condition | | |
|---|---|---|---|---|---|---|---|---|
| | $M_w(P)$ | $M_z(P)/M_w(P)$ | $M_{Z+1}(p)/M_w(P)$ | Viscosity (Pa · s) | Polymer Concentration (%) | Draft Ratio at Spinning | Draw Ratio after Drying | Drawing Method |
| Comparative Example 1 | 40 | 1.8 | 3.0 | 50 | 20 | 3 | 5.2 | Steam |
| Comparative Example 2 | 40 | 1.8 | 3.0 | 50 | 20 | 5 | 3.0 | Dry Heat |
| Example 1 | 48 | 5.7 | 14 | 45 | 20 | 3 | 5.2 | Steam |
| Example 2 | 48 | 5.7 | 14 | 45 | 20 | 12 | 1.1 | Dry Heat |
| Example 3 | 48 | 5.7 | 14 | 45 | 20 | 12 | 2.0 | Dry Heat |
| Example 4 | 34 | 2.7 | 7.2 | 40 | 20 | 3 | 5.2 | Steam |
| Example 5 | 32 | 3.4 | 12 | 35 | 20 | 3 | 5.2 | Steam |
| Example 6 | 40 | 5.2 | 10 | 55 | 20 | 12 | 1.1 | Dry Heat |
| Comparative Example 3 | 65 | 1.8 | 3.0 | 95 | 15 | 3 | 5.2 | Steam |
| Comparative Example 4 | 65 | 1.8 | 3.0 | 95 | 15 | 12 | 1.1 | Dry Heat |
| Example 7 | 20 | 3.3 | 14. | 95 | 27 | 10 | 5.2 | Dry Heat |
| Example 8 | 59 | 5.2 | 14 | 10 | 10 | 24 | 1.1 | Dry Heat |
| Comparative Example 5 | 48 | 5.7 | 14 | 45 | 20 | 3 | 5.2 | Steam |

| | Spinning Condition Total Draw Ratio | Properties of Precursor Fiber | | | | | |
|---|---|---|---|---|---|---|---|
| | | $M_w(F)$ | $M_z(F)/M_w(F)$ | The Degree of Orientation (%) | Fineness (dtex) | Limited Oxidation Draw Ratio | Weibull Shape Parameter m(P) |
| Comparative Example 1 | 13.8 | 28 | 1.6 | 93 | 0.7 | 1.2 | 10 |
| Comparative Example 2 | 8.3 | 28 | 1.7 | 86 | 0_7 | 1.8 | 10 |
| Example 1 | 13.8 | 35 | 2.0 | 93 | 0.7 | 1.3 | 11 |
| Example 2 | 2.7 | 37 | 4.0 | 86 | 1.0 | 3.0 | 15 |
| Example 3 | 3.5 | 36 | 3.5 | 87 | 0.7 | 2.4 | 15 |
| Example 4 | 13.8 | 32 | 2.5 | 93 | 0.7 | 1.3 | 13 |
| Example 5 | 13.8 | 31 | 3.3 | 93 | 0.7 | 1.3 | 14 |
| Example 6 | 2.7 | 35 | 4.2 | 88 | 1.0 | 2.8 | 16 |
| Comparative Example 3 | 13.8 | 29 | 1.8 | 93 | 0.7 | 1.2 | 10 |
| Comparative Example 4 | 2.7 | 41 | 1.8 | 86 | 1.0 | 1.8 | 9 |
| Example 7 | 5.5 | 20 | 3.3 | 90 | 0.7 | 1.5 | 12 |
| Example 8 | 2.7 | 50 | 4.5 | 86 | 1.0 | 3.4 | 13 |
| Comparative Example 5 | 13.8 | 34 | 1.9 | 93 | 0.7 | 1.2 | 10 |

TABLE 2

| | | | The Crystallite | Carbon Fiber | |
|---|---|---|---|---|---|
| | Used Precursor Fiber | Oxidation Draw Ratio | Orientation of Degree for oxidized fiber (%) | Strength (Gpa) | Elastic Modulus (Gpa) |
| Example 9 | Example 1 | 1.15 | 86 | 6.3 | 335 |
| Example 10 | Example 4 | 1.15 | 86 | 6.5 | 335 |
| Example 11 | Example 5 | 1.15 | 86 | 6.8 | 335 |
| Comparative Example 6 | Comparative Example 1 | 1.15 | 86 | 6.0 | 335 |
| Example 12 | Example 2 | 1.2 | 78 | 6.0 | 325 |
| Example 13 | Example 2 | 1.4 | 80 | 6.7 | 330 |
| Example 14 | Example 2 | 1.6 | 83 | 7.2 | 335 |
| Example 15 | Example 3 | 1.2 | 78 | 6.5 | 325 |
| Example 16 | Example 3 | 1.4 | 80 | 7.0 | 330 |
| Example 17 | Example 3 | 1.6 | 83 | 7.5 | 335 |
| Comparative Example 7 | Comparative Example 2 | 1.2 | 78 | 5.4 | 325 |
| Comparative Example 8 | Comparative Example 2 | 1.4 | 80 | 5.8 | 330 |

TABLE 3

| | Carbonization Temperature (° C.) | Strength (Gpa) | Elastic Modulus (Gpa) | Lc (nm) | Raman Spectroscopy $I_D/I_G$ | $I_V/I_G$ | $V_G$ | $V_G$ + 17Iv/$I_G$ | Weibull Plot m | m' | $R^2$ |
|---|---|---|---|---|---|---|---|---|---|---|---|
| Example 18 | 1300 | 7.8 | 290 | 1.8 | 0.886 | 0.754 | 1592.4 | 1605 | 7.3 | 6.7 | 0.95 |
| Example 19 | 1400 | 7.6 | 310 | 1.9 | 0.858 | 0.678 | 1595.9 | 1607 | 7.2 | 6.7 | 0.97 |
| Example 17 | 1500 | 7.5 | 335 | 2.1 | 0.835 | 0.547 | 1599.0 | 1608 | 7.0 | 6.7 | 0.99 |
| Example 20 | 1650 | 7.4 | 350 | 2.3 | 0.806 | 0.432 | 1598.1 | 1605 | 6.4 | 5.2 | 0.96 |
| Example 10 | 1500 | 6.5 | 335 | 2.1 | 0.834 | 0.547 | 1596.1 | 1605 | 6.3 | 6.0 | 0.98 |
| Comparative Example 9 | 1300 | 6.2 | 290 | 1.8 | 0.885 | 0.775 | 1588.4 | 1602 | 4.3 | 4.0 | 0.98 |
| Comparative Example 10 | 1400 | 6.2 | 310 | 1.9 | 0.867 | 0.693 | 1591.5 | 1603 | 4.2 | 3.8 | 0.98 |
| Comparative Example 6 | 1500 | 6.0 | 335 | 2.1 | 0.837 | 0.550 | 1595.0 | 1604 | 3.8 | 3.6 | 0.99 |
| Comparative Example 11 | 1650 | 5.5 | 350 | 2.3 | 0.809 | 0.440 | 1596.7 | 1604 | 3.6 | 3.3 | 0.97 |
| Comparative Example 5 | 1500 | 6.5 | 335 | 2.1 | 0.834 | 0.548 | 1595.1 | 1604 | 6.0 | 5.7 | 0.98 |

The invention claimed is:

1. A precursor fiber having a weight average molecular weight $M_w(F)$ of 200,000 to 700,000 and a degree of polydispersity $M_Z(F)/M_w(F)$, wherein $M_Z(F)$ indicates Z-average molecular weight of the precursor for carbon fiber, of 2 to 5.

2. The precursor fiber according to claim 1, having a Weibull shape parameter m(P) of a single fiber tensile strength of 11 or more.

3. The precursor fiber according to claim 1, having a crystallite orientation degree of 85 to 90%.

4. A process for producing the carbon fiber precursor fiber according to claim 1 comprising:

forming a spinning solution by dissolving in a solvent a polyacrylonitrile-based polymer having a weight average molecular weight $M_w(P)$ of 200,000 to 700,000 and the degree of polydispersity $M_Z(P)/M_w(P)$, wherein $M_Z(P)$ indicates Z-average molecular weight of a polymer in the spinning solution, of 2.7 to 6 at a concentration of 5 wt % or more and less than 30 wt %, subjecting the spinning solution to spinning to obtain a swelling fiber, and subjecting the swelling fiber to drawing and a dry heat treatment to obtain the carbon fiber precursor fiber.

5. The process according to claim 4, wherein dry heat drawing at a draw ratio of 1.1 to 6 is carried out after the dry heat treatment.

6. The process according to claim 4, wherein the spinning solution is subjected to filtration through a filter with a filtration accuracy of 3 to 15 μm and then to spinning.

* * * * *